US009324213B2

(12) United States Patent
Herrmann et al.

(10) Patent No.: US 9,324,213 B2
(45) **Date of Patent: *Apr. 26, 2016**

(54) SYSTEM AND METHOD FOR INCREASING PLAYER PARTICIPATION

(71) Applicant: Scientific Games Holdings Limited, Ballymahon, Co. Longford. (IE)

(72) Inventors: Mark E. Herrmann, Wellesley, MA (US); John E. Taylor, Vero Beach, FL (US); Scott N. Weller, Windham, NH (US); Dow K. Hardy, Marlborough, MA (US); Francis J. Lichtenberger, Winchester, MA (US); Michael C. Lightman, Easton, MA (US); Matthew S. Ross, Needham, MA (US)

(73) Assignee: Scientific Games Holdings Limited, Ballymahon, Co. Longford. (IE)

( * ) Notice: Subject to any disclaimer, the term of this patent is extended or adjusted under 35 U.S.C. 154(b) by 0 days.

This patent is subject to a terminal disclaimer.

(21) Appl. No.: 14/094,848

(22) Filed: Dec. 3, 2013

(65) Prior Publication Data

US 2014/0087811 A1 Mar. 27, 2014

Related U.S. Application Data

(63) Continuation of application No. 12/829,628, filed on Jul. 2, 2010, now Pat. No. 8,597,109.

(60) Provisional application No. 61/222,647, filed on Jul. 2, 2009.

(51) Int. Cl.
*G07F 17/32* (2006.01)

(52) U.S. Cl.
CPC ..... *G07F 17/3286* (2013.01); *G07F 17/32* (2013.01); *G07F 17/3239* (2013.01); *G07F 17/3244* (2013.01); *G07F 17/3255* (2013.01); *G07F 17/3262* (2013.01); *G07F 17/3267* (2013.01)

(58) Field of Classification Search
USPC ..... 463/16–25, 40–42; 273/292
See application file for complete search history.

(56) References Cited

U.S. PATENT DOCUMENTS

| | | | |
|---|---|---|---|
| 6,656,050 | B2 | 12/2003 | Busch et al. |
| 6,663,105 | B1 | 12/2003 | Sullivan et al. |
| 7,008,317 | B2 | 3/2006 | Cote et al. |
| 7,285,045 | B2 | 10/2007 | Schneier et al. |
| 7,303,468 | B2 | 12/2007 | Schneier et al. |
| 7,699,706 | B2 | 4/2010 | Walker et al. |
| 7,914,370 | B2 | 3/2011 | Weller |
| 2004/0219982 | A1 | 11/2004 | Khoo et al. |
| 2005/0170883 | A1 | 8/2005 | Muskin |
| 2006/0178187 | A1 | 8/2006 | Walker et al. |
| 2007/0026924 | A1 | 2/2007 | Taylor |

(Continued)

OTHER PUBLICATIONS

Search Report and Written Opinion for PCT/US2010/040950 dated Sep. 23, 2010, 10 pages.

*Primary Examiner* — Masud Ahmed
(74) *Attorney, Agent, or Firm* — Dority & Manning, P.A.

(57) ABSTRACT

A system and method are provided to combine a gambling establishment player club with one or more second chance games. Players are thereby given multiple opportunities and incentives to interact with the gambling establishment and player club. The gambling establishment is thereby able to gather valuable player data, build player profiles, and incentivize players to take actions desired by the gambling establishment.

20 Claims, 8 Drawing Sheets

(56) References Cited

U.S. PATENT DOCUMENTS

| | | | |
|---|---|---|---|
| 2007/0149267 | A1 | 6/2007 | Ross et al. |
| 2007/0173322 | A1 | 7/2007 | Swamy et al. |
| 2007/0265055 | A1 | 11/2007 | Berman |
| 2008/0009344 | A1 | 1/2008 | Graham et al. |
| 2008/0032762 | A1 | 2/2008 | Kane et al. |
| 2008/0045299 | A1 | 2/2008 | Bennett et al. |
| 2008/0064492 | A1 | 3/2008 | Oosthoek |
| 2008/0146346 | A1 | 6/2008 | Hardy et al. |
| 2009/0023490 | A1 | 1/2009 | Moshal et al. |
| 2009/0093300 | A1 | 4/2009 | Lutnick et al. |
| 2009/0176578 | A1 | 7/2009 | Herrmann et al. |
| 2009/0191962 | A1 | 7/2009 | Hardy et al. |
| 2009/0197672 | A1 | 8/2009 | Kelly et al. |
| 2009/0209350 | A1 | 8/2009 | Kelly et al. |
| 2010/0029376 | A1 | 2/2010 | Hardy et al. |
| 2011/0053673 | A1 | 3/2011 | Hardy et al. |

SYSTEM AND METHOD FOR INCREASING PLAYER PARTICIPATION

RELATED APPLICATIONS

The present application is a Continuation Application of U.S. application Ser. No. 12/829,628, filed Jul. 2, 2010, which claims priority to U.S. Provisional Application Ser. No. 61/222,647, filed Jul. 2, 2009, which application is incorporated herein by reference in its entirety.

FIELD OF INVENTION

The field of the invention relates generally to gaming, and more particularly to increasing gambling establishment (e.g., casino, lottery or other lawful physical or online gambling establishments) player participation and collecting and using information relating to players.

BACKGROUND

It can be appreciated that gambling establishments (e.g., casino, lottery or other lawful physical or online gambling establishments) have a desire to keep their players engaged and interested in their brand. Player loyalty clubs, "member's only" clubs, or similar programs are a common method used by gambling establishments to attempt to achieve this goal. These clubs typically provide one or more benefits to players, such as discounts, advanced notification of news and events, mailing lists, and other benefits.

"Second chance" games are another method that may be used by some gambling establishments to increase participation and brand interaction. These second chance games typically attempt to reward a player's losing efforts by making the player eligible to participate in a second chance drawing, contest, or event. For casino establishments, second chance games can be offered as bonuses and/or bonus games.

While player clubs can be a valuable tool for gambling establishments, the clubs typically are not very engaging and they do not provide an adequate incentive for players to regularly interact with the player club or the gambling establishment, especially regarding interactions beyond the actual act of gambling. Similarly, second chance games typically are not very interactive or engaging and they often do not generate a level of excitement or interest necessary to promote prolonged interaction with the gambling establishment or its brand. For example conventional second chance games typically involve mailing in redemption forms, with little or no notice of what has transpires in the second chance.

SUMMARY

Improved methods are required to provide players with multiple incentives and multiple opportunities to interact with the gambling establishment or its brand to help gambling establishments increase customer loyalty and participation. Moreover, improvements over conventional passive second chance games are needed. Such methods can also be used to gather important information about their players. Through the increased interaction, increased loyalty, and the gathered information, the gambling establishment can advance many goals such as providing an improved player experience, further increasing player interaction and loyalty, increasing play, or motivating the player to take some action desired by the gambling establishment.

According to one aspect a computer implemented method for conducting a game of chance is provided. The method comprises the acts of associating on a computer system a primary game having a primary win opportunity with a second game, providing a computer environment hosting the second game having a second chance win opportunity, requiring that a player of the second chance game be uniquely identified in order to participate in the second chance win opportunity, providing a second chance game interface accessible online, and permitting the player to play the second game online through the second chance game interface, wherein the second chance game reveals an outcome of the second chance win opportunity. According to one embodiment, the primary game includes a portion of the primary game played offline and a partial game result obtained offline, and a portion of the primary game played online and a remaining portion of a game result obtained online. According to another embodiment, the portion of the primary game that is played offline including one or more areas of a game ticket capable of being revealed offline, the portion of the game result obtained online including one or more outcomes corresponding to one or more areas of the game ticket that cannot be revealed offline. According to another embodiment, the act of requiring the player be uniquely identified includes an act of requiring that the player enter into a membership club. According to another embodiment, the membership club is a frequent player club for a gambling establishment.

According to another embodiment, the method further comprises an act of permitting the player to redeem the outcome of the second chance game, and wherein the act of requiring the player be uniquely identified occurs in response to the act of permitting the player to redeem the outcome. According to another embodiment, the act of requiring the player be uniquely identified includes an act associating an anonymous identifier with the player. According to another embodiment, the act of requiring the player be uniquely identified includes an act associating an anonymous identifier with the second chance opportunity. According to another embodiment, the act of requiring that the player of the second chance game be uniquely identified occurs before the player is permitted to play the second chance game. According to another embodiment, the method further comprises an act of providing a second chance identifier to the player, wherein the second chance identifier is used to access the second chance game.

According to another embodiment, the act of providing the second game having a second chance win opportunity occurs in response to an activity performed by the player. According to another embodiment, the activity performed by the player comprises gambling activity. According to another embodiment, the activity performed by the player includes visiting at least one of gambling activity, activity in a gaming establishment, activity in a redemption location, activity in an affiliated location, activity in a partner location, and activity in a predetermined online or physical location. According to another embodiment, the second chance identifier includes at least one of a symbol, code, text, and a unique identifier. According to another embodiment, the act of associating the primary game having a primary win opportunity with a second game includes an act of associating game detail of the primary game with a second chance identifier. According to another embodiment, the game detail includes at least one of nature of game, type of game, value of game, time play, location of play, place of purchase, theme of game, storyline of game, point in time of storyline of game, and other details associated with the primary game.

According to another embodiment, the method further comprises an act of permitting the player to select from a plurality of second chance games. According to another embodiment, the method further comprises an act of awarding game credits, wherein the game credits are required to play the second chance game. According to another embodiment, the act of awarding game credits occurs in response to at least one of receiving a valid second chance identifier, reaching a scheduled distribution period, reaching a predefined event associated with a gaming establishment, and reaching a predefined event associated with the player's information. According to another embodiment, the act of awarding game credits includes an act of identifying a range of game credits awarded, and further comprising an act of requiring a player action to determine a number of the game credits awarded.

According to another embodiment, the method further comprises an act of adjusting the outcome of the second chance win opportunity based at least in part on player status information. According to another embodiment, the player status information includes at least one of a membership level, historical gaming activity by the player, predicted gaming activity by the player, tracked player behavior, predicted player behavior, and observed or predicted player preferences or affinities. According to another embodiment, the act of requiring that a player of the second chance game be uniquely identified, includes an act of determining, by a computer system, whether the player is registered for a membership club, and permitting the player to register for the membership club responsive to determining the player is not registered through the second chance game interface. According to another embodiment, the second chance game interface comprises a computer based interface displayed on a computer system, wherein the second chance game interface is accessed through at least one of a web site, an online interface, a physical location, a gambling location, a gaming location, an affiliated location, a redemption location, and a portable device such as a PDA, telephone, or portable gaming device. According to another embodiment, the primary game comprises a lottery. According to another embodiment, the player purchases a ticket to participate in the lottery, and the act of associating the primary game having the primary win opportunity with the second game includes an act of printing a second chance identifier on the ticket. According to another embodiment, the primary game comprises at least one of a game of skill, a game of chance, a game of skill and chance, a game provided at a gambling location, and a game provided by an affiliated location.

According to another embodiment, the method further comprises the acts of establishing a threshold number of second chance win opportunities, determining, by a computer system if the threshold has been exceeded, and preventing further second chance play in response to the determination that the threshold has been exceeded. According to another embodiment, the second chance game is provided in response to a losing outcome in the primary game. According to another embodiment, the method further comprises further comprising an act of permitting the player to accumulate second chance win opportunities. According to another embodiment, the second chance game interface permits the player to view at least one of a player status, accumulated second chance win opportunities, accumulated second chance wins, a plurality of second chance games, and status information associated with a plurality of second chance games.

According to another embodiment, the method further comprises an act of determining the outcome of the second chance game. According to another embodiment, the outcome of the second chance game is predetermined. According to another embodiment, the outcome of the second chance game is determined in response to access to the second chance game. According to another embodiment, the method further comprises an act of printing a second chance identifier on at least one of an issued ticket, a receipt, a scratch ticket, a lottery ticket, a receipt for purchase, a receipt for an award, a ticket to an event, another receipt, a direct market mailing, an electronic communication, a cellular network communication, a wireless device communication, and a newspaper advertisement, and/or conveying a second chance identifier verbally via at least one of a telephone network, an advertisement, and a public address system. According to another embodiment, the outcome of the second chance win opportunity includes an entry into a sweepstakes, wherein a wining result of the sweepstakes includes at least one of an award, an incentive, and a benefit for the player. According to another embodiment, the second chance game interface includes an interface for tracking and managing sweepstakes entries.

According to another embodiment, the method further comprises an act of permitting a player to accumulate sweepstakes entries. According to another embodiment, further comprises an act of permitting the player to select at least one sweepstakes game, from a plurality of sweepstakes games, to enter using accumulated sweepstakes entries. According to another embodiment, the method further comprises an act of collecting player information. According to another embodiment, the player information includes at least one of information associated with play of the primary game, play of the second chance game, activities performed by the player associated with the second chance game, player preferences, player affinities, demographic information, and personal information. According to another embodiment, the method further comprises an act of generating a player profile from collected player information.

According to another embodiment, the act of collecting player information includes acts of associating information on the primary game with a second chance identifier, and storing information on the primary game in response to access of the second chance game. According to another embodiment, the act of collecting player information includes acts of associating non gaming activity with a second chance identifier, and storing information on the non gaming activity in response to access of the second chance game. According to another embodiment, the act of collecting player information includes an act of accepting player information entered by the player. According to another embodiment, the method further comprises an act of generating player preferences from collected information. According to another embodiment, the collected information is associated with an anonymous identifier. According to another embodiment, the method further comprises an act of customizing the second chance game to the player profile. According to another embodiment, the method further comprises an act of customizing the primary game to the player profile. According to another embodiment, the act of customizing the second chance game to the player profile includes an act of establishing the outcome of the second chance win opportunity to conform to a player preference or affinity identified at least in part by the player profile.

According to another embodiment, the act of customizing the second chance game to the player profile includes predicting player reaction to an incentive offer based at least in part the player profile. According to another embodiment, the method further comprises an act of generating a player population profile, wherein the player population profile includes aggregate information from a plurality of players. According to another embodiment, the method further comprises acts of identifying a desired player activity, and establishing the desired player activity as a qualification for participation in the second chance game. According to another embodiment, the desired activity includes the player visiting online or physically at least one of a select merchant, a gambling location, a gaming location, a partner location, and an affiliated location. According to another embodiment, the desired player activity further includes requiring the player perform a specific action at the visited location. According to another embodiment, method further comprises an act of tailoring the desired player activity to a player profile.

According to another embodiment, method further comprises acts of associating a plurality of second chance entries into a group, and permitting the player to register the group of second chance entries. According to another embodiment, the method further comprises an act of storing player preference information with a player identifier. According to another embodiment, the player identifier associated with a frequent player club membership. According to another embodiment, the method further comprises an act of permitting access to at least one of a player status, accumulated second chance win opportunities, accumulated second chance wins, a plurality of second chance games, and status information associated with a plurality of second chance games outside the second chance game interface. According to another embodiment, the second chance game interface permits a user to view at least one of a player status, accumulated second chance win opportunities, accumulated second chance wins, and status information associated with a plurality of second chance games.

According to another embodiment, the method further comprises an act of continuing at least one aspect of the primary game in the second chance game based at least in part on the second chance identifier. According to another embodiment, the act of continuing includes an act of providing the player a primary game identifier that enables a new play of the primary game to continue one or more aspects of the secondary game. According to another embodiment, the outcome of the second chance game is determined before play of the second chance game. According to another embodiment, the outcome of the second chance game is determined during play of the second chance game. According to another embodiment, the outcome of the second chance game is determined based, at least in part, on collected or predicted player profile information.

According to another embodiment, the second chance game includes at least one of an award, an incentive, and a benefit for the player. According to another embodiment, the incentive includes an incentive to obtain to obtain a second chance identifier, and at least one of the incentive, the outcome of the second chance game, and the award of the second chance game is determined, at least in part, by a desired action of at least one of the gambling establishment, a partner, an advertiser, and an affiliate. According to another embodiment, at least one of the incentive to obtain the second chance identifier, the outcome of the second chance game, and the award of the second chance game is determined at least in part by a matching desired player profile attribute with player attribute(s) desired by the at least one of the gambling establishment, a partner, advertiser, and an affiliate. According to another embodiment, any second chance incentives and awards are funded, at least in part, by at least one of affiliates, advertisers, and partners. According to another embodiment, any second chance incentives and awards are sponsored, at least in part, by at least one of affiliates, advertisers, and partners.

According to one aspect of the present invention, a non-transient computer-readable medium having computer-readable instructions stored thereon that, as a result of being executed by a processor, instruct the processor to perform a method for conducting a game of chance is provided. The method comprises the acts of associating a primary game having a primary win opportunity with a second game, providing the second game having a second chance win opportunity, requiring that a player of the second chance game be uniquely identified, providing a second chance game interface, and permitting the player to play a second game through the second chance game interface, wherein the second chance game reveals an outcome of the second chance win opportunity. According to one embodiment, the primary game includes a portion of the primary game played offline and a partial game result obtained offline, and a portion of the primary game played online and a remaining portion of a game result obtained online. According to another embodiment, the portion of the primary game that is played offline including one or more areas of a game ticket capable of being revealed offline, the portion of the game result obtained online including one or more outcomes corresponding to one or more areas of the game ticket that cannot be revealed offline. According to another embodiment, the act of requiring the player be uniquely identified includes an act of requiring that the player enter into a membership club. According to another embodiment, the membership club is a frequent player club for a gambling establishment.

According to another embodiment, the method further comprises an act of permitting the player to redeem the outcome of the second chance game, and wherein the act of requiring the player be uniquely identified occurs in response to the act of permitting the player to redeem the outcome. According to another embodiment, the act of requiring the player be uniquely identified includes an act associating an anonymous identifier with the player. According to another embodiment, the act of requiring the player be uniquely identified includes an act associating an anonymous identifier with the second chance opportunity. According to another embodiment, the act of requiring that the player of the second chance game be uniquely identified occurs before the player is permitted to play the second chance game. According to another embodiment, the method further comprises an act of providing a second chance identifier to the player, wherein the second chance identifier is used to access the second chance game.

According to another embodiment, the act of providing the second game having a second chance win opportunity occurs in response to an activity performed by the player. According to another embodiment, the activity performed by the player comprises gambling activity. According to another embodiment, the activity performed by the player includes visiting at least one of gambling activity, activity in a gaming establishment, activity in a redemption location, activity in an affiliated location, activity in a partner location, and activity in a predetermined online or physical location. According to another embodiment, the second chance identifier includes at least one of a symbol, code, text, and a unique identifier. According to another embodiment, the act of associating the primary game having a primary win opportunity with a second game includes an act of associating game detail of the primary game with a second chance identifier. According to another embodiment, the game detail includes at least one of nature of game, type of game, value of game, time play, location of play, place of purchase, theme of game, storyline of game, point in time of storyline of game, and other details associated with the primary game.

According to another embodiment, the method further comprises an act of permitting the player to select from a plurality of second chance games. According to another embodiment, the method further comprises an act of awarding game credits, wherein the game credits are required to play the second chance game. According to another embodiment, the act of awarding game credits occurs in response to at least one of receiving a valid second chance identifier, reaching a scheduled distribution period, reaching a predefined event associated with a gaming establishment, and reaching a predefined event associated with the player's information. According to another embodiment, the act of awarding game credits includes an act of identifying a range of game credits awarded, and further comprising an act of requiring a player action to determine a number of the game credits awarded.

According to another embodiment, the method further comprises an act of adjusting the outcome of the second chance win opportunity based at least in part on player status information. According to another embodiment, the player status information includes at least one of a membership level, historical gaming activity by the player, predicted gaming activity by the player, tracked player behavior, predicted player behavior, and observed or predicted player preferences or affinities. According to another embodiment, the act of requiring that a player of the second chance game be uniquely identified, includes an act of determining, by a computer system, whether the player is registered for a membership club, and permitting the player to register for the membership club responsive to determining the player is not registered through the second chance game interface. According to another embodiment, the second chance game interface comprises a computer based interface displayed on a computer system, wherein the second chance game interface is accessed through at least one of a web site, an online interface, a physical location, a gambling location, a gaming location, an affiliated location, a redemption location, and a portable device such as a PDA, telephone, or portable gaming device. According to another embodiment, the primary game comprises a lottery. According to another embodiment, the player purchases a ticket to participate in the lottery, and the act of associating the primary game having the primary win opportunity with the second game includes an act of printing a second chance identifier on the ticket. According to another embodiment, the primary game comprises at least one of a game of skill, a game of chance, a game of skill and chance, a game provided at a gambling location, and a game provided by an affiliated location.

According to another embodiment, the method further comprises the acts of establishing a threshold number of second chance win opportunities, determining, by a computer system if the threshold has been exceeded, and preventing further second chance play in response to the determination that the threshold has been exceeded. According to another embodiment, the second chance game is provided in response to a losing outcome in the primary game. According to another embodiment, the method further comprises further comprising an act of permitting the player to accumulate second chance win opportunities. According to another embodiment, the second chance game interface permits the player to view at least one of a player status, accumulated second chance win opportunities, accumulated second chance wins, a plurality of second chance games, and status information associated with a plurality of second chance games.

According to another embodiment, the method further comprises an act of determining the outcome of the second chance game. According to another embodiment, the outcome of the second chance game is predetermined. According to another embodiment, the outcome of the second chance game is determined in response to access to the second chance game. According to another embodiment, the method further comprises an act of printing a second chance identifier on at least one of an issued ticket, a receipt, a scratch ticket, a lottery ticket, a receipt for purchase, a receipt for an award, a ticket to an event, an other receipt, a direct market mailing, an electronic communication, a cellular network communication, a wireless device communication, and a newspaper advertisement, and/or conveying a second chance identifier verbally via at least one of a telephone network, an advertisement, and a public address system. According to another embodiment, the outcome of the second chance win opportunity includes an entry into a sweepstakes, wherein a wining result of the sweepstakes includes at least one of an award, an incentive, and a benefit for the player. According to another embodiment, the second chance game interface includes an interface for tracking and managing sweepstakes entries.

According to another embodiment, the method further comprises an act of permitting a player to accumulate sweepstakes entries. According to another embodiment, further comprises an act of permitting the player to select at least one sweepstakes game, from a plurality of sweepstakes games, to enter using accumulated sweepstakes entries. According to another embodiment, the method further comprises an act of collecting player information. According to another embodiment, the player information includes at least one of information associated with play of the primary game, play of the second chance game, activities performed by the player associated with the second chance game, player preferences, player affinities, demographic information, and personal information. According to another embodiment, the method further comprises an act of generating a player profile from collected player information.

According to another embodiment, the act of collecting player information includes acts of associating information on the primary game with a second chance identifier, and storing information on the primary game in response to access of the second chance game. According to another embodiment, the act of collecting player information includes acts of associating non gaming activity with a second chance identifier, and storing information on the non gaming activity in response to access of the second chance game. According to another embodiment, the act of collecting player information includes an act of accepting player information entered by the player. According to another embodiment, the method further comprises an act of generating player preferences from collected information. According to another embodiment, the collected information is associated with an anonymous identifier. According to another embodiment, the method further comprises an act of customizing the second chance game to the player profile. According to another embodiment, the method further comprises an act of customizing the primary game to the player profile. According to another embodiment, the act of customizing the second chance game to the player profile includes an act of establishing the outcome of the second chance win opportunity to conform to a player preference or affinity identified at least in part by the player profile.

According to another embodiment, the act of customizing the second chance game to the player profile includes predicting player reaction to an incentive offer based at least in part the player profile. According to another embodiment, the method further comprises an act of generating a player population profile, wherein the player population profile includes aggregate information from a plurality of players. According to another embodiment, the method further comprises acts of identifying a desired player activity, and establishing the desired player activity as a qualification for participation in the second chance game. According to another embodiment, the desired activity includes the player visiting online or physically at least one of a select merchant, a gambling location, a gaming location, a partner location, and an affiliated location. According to another embodiment, the desired player activity further includes requiring the player perform a specific action at the visited location. According to another embodiment, method further comprises an act of tailoring the desired player activity to a player profile.

According to another embodiment, method further comprises acts of associating a plurality of second chance entries into a group, and permitting the player to register the group of second chance entries. According to another embodiment, the method further comprises an act of storing player preference information with a player identifier. According to another embodiment, the player identifier associated with a frequent player club membership. According to another embodiment, the method further comprises an act of permitting access to at least one of a player status, accumulated second chance win opportunities, accumulated second chance wins, a plurality of second chance games, and status information associated with a plurality of second chance games outside the second chance game interface. According to another embodiment, the second chance game interface permits a user to view at least one of a player status, accumulated second chance win opportunities, accumulated second chance wins, and status information associated with a plurality of second chance games.

According to another embodiment, the method further comprises an act of continuing at least one aspect of the primary game in the second chance game based at least in part on the second chance identifier. According to another embodiment, the act of continuing includes an act of providing the player a primary game identifier that enables a new play of the primary game to continue one or more aspects of the secondary game. According to another embodiment, the outcome of the second chance game is determined before play of the second chance game. According to another embodiment, the outcome of the second chance game is determined during play of the second chance game. According to another embodiment, the outcome of the second chance game is determined based, at least in part, on collected or predicted player profile information.

According to another embodiment, the second chance game includes at least one of an award, an incentive, and a benefit for the player. According to another embodiment, the incentive includes an incentive to obtain to obtain a second chance identifier, and at least one of the incentive, the outcome of the second chance game, and the award of the second chance game is determined, at least in part, by a desired action of at least one of the gambling establishment, a partner, an advertiser, and an affiliate. According to another embodiment, at least one of the incentive to obtain the second chance identifier, the outcome of the second chance game, and the award of the second chance game is determined at least in part by a matching desired player profile attribute with player attribute(s) desired by the at least one of the gambling establishment, a partner, advertiser, and an affiliate. According to another embodiment, any second chance incentives and awards are funded, at least in part, by at least one of affiliates, advertisers, and partners. According to another embodiment, any second chance incentives and awards are sponsored, at least in part, by at least one of affiliates, advertisers, and partners.

According to one aspect of the present invention, a system for conducting a game of chance is provided. The system comprises an association component configured to associate a primary game having a primary win opportunity with a second game, a second chance system configured to provide the second game having a second chance win opportunity, wherein the second game system further comprises a second chance game interface, wherein the second chance game interface is configured to permit the player to play a second game online, and reveal an outcome of the second chance win opportunity, and an identification component configured to uniquely identify the player, wherein the player is required to be uniquely identified in order to complete the second chance win opportunity. According to one embodiment of the present invention, the primary game includes a portion of the primary game played offline and a partial game result obtained offline, and a portion of the primary game played online and a remaining portion of a game result obtained online.

According to another embodiment of the invention, the portion of the primary game that is played offline including one or more areas of a game ticket capable of being revealed offline, the portion of the game result obtained online including one or more outcomes corresponding to one or more areas of the game ticket that cannot be revealed offline. According to another embodiment of the invention, the second game includes a portion of the second game played offline and a partial game result obtained offline, and a portion of the second game played online and a remaining portion of a game result obtained online. According to another embodiment of the invention, the identification component is further configured to require that the player enter into a membership club. According to another embodiment of the invention, the identification component is further configured to require the player be uniquely identified in response to redemption of the outcome of the second chance win opportunity.

According to one embodiment of the present invention, the identification component is further configured to associate an anonymous identifier with the player. According to another embodiment of the invention, the identification component is further configured to associate an anonymous identifier with the second chance opportunity. According to another embodiment of the invention, the identification component is further configured to require that the player of the second chance game be uniquely identified before the player is permitted to play the second chance game. According to another embodiment of the invention, the system further comprises a generation component configured to provide a second chance identifier to the player, wherein the second chance identifier is used to access the second chance game. According to another embodiment of the invention, the second chance system is configure to provide the second game having a second chance win opportunity in response to an activity performed by the player. According to another embodiment of the invention, the activity performed by the player comprises gambling activity. According to another embodiment of the invention, the activity performed by the player includes visiting at least one of gambling activity, activity in a gaming establishment, activity in a redemption location, activity in an affiliated location, activity in a partner location, and activity in a predetermined online or physical location.

According to another embodiment of the invention, the second chance identifier includes at least one of a symbol, code, text, and a unique identifier. According to another embodiment of the invention, the association component is further configured to associate game detail of the primary game with a second chance identifier. According to one embodiment of the present invention, the game detail includes at least one of nature of game, type of game, value of game, time play, location of play, place of purchase, theme of game, storyline of game, point in time of storyline of game, and other details associated with the primary game. According to another embodiment of the invention, the second chance system further comprises a selection component configured to permit the player to select from a plurality of second chance games. According to another embodiment of the invention, the second chance system is further configured to award game credits, wherein the game credits are required to play the second chance game.

According to another embodiment of the invention, award of the game credits occurs in response to at least one of receiving a valid second chance identifier, reaching a scheduled distribution period, reaching a predefined event associated with a gaming establishment, and reaching a predefined event associated with the player's information. According to another embodiment of the invention, the second chance system is further configured to provide an indicator of an award of game credits comprising a range of a number of game credits awarded. According to another embodiment of the invention, the second chance system is further configured to require a player action to determine a number of the game credits awarded. According to another embodiment of the invention, the system is configured to adjust the outcome of the second chance win opportunity based at least in part on player status information.

According to one embodiment of the present invention, the player status information includes at least one of a membership level, historical gaming activity by the player, predicted gaming activity by the player, tracked player behavior, predicted player behavior, and observed or predicted player preferences or affinities. According to another embodiment of the invention, the second chance game interface comprises a computer based interface displayed on a computer system, wherein the second chance game interface is accessed through at least one of a web site, an online interface, a physical location, a gambling location, a gaming location, an affiliated location, a redemption location, and a portable device such as a PDA, telephone, or portable gaming device. According to another embodiment of the invention, the primary game comprises a lottery. According to another embodiment of the invention, a player purchases a ticket to participate in the lottery, and the act of associating the primary game having the primary win opportunity with the second game includes an act of printing a second chance identifier on the ticket. According to another embodiment of the invention, the primary game comprises at least one of a game of skill, a game of chance, a game of skill and chance, a game provided at a gambling location, and a game provided by an affiliated location.

According to another embodiment of the invention, the system is configured to establish a threshold number of second chance win opportunities, determine, if the threshold has been exceeded, and prevent further second chance play in response to a determination that the threshold has been exceeded. According to another embodiment of the invention, the second chance game is provided in response to a losing outcome in the primary game. According to another embodiment of the invention, the system is configured to permit the player to accumulate second chance win opportunities.

According to one embodiment of the present invention, the second chance game interface permits the player to view at least one of a player status, accumulated second chance win opportunities, accumulated second chance wins, a plurality of second chance games, and status information associated with a plurality of second chance games. According to another embodiment of the invention, the system is configured to determine the outcome of the second chance game. According to another embodiment of the invention, the outcome of the second chance game is predetermined. According to another embodiment of the invention, the outcome of the second chance game is determined in response to access to the second chance game. According to another embodiment of the invention, the system is configured to print a second chance identifier on at least one of an issued ticket, a receipt, a scratch ticket, a lottery ticket, a receipt for purchase, a receipt for an award, a ticket to an event, another receipt, a direct market mailing, an electronic communication, a cellular network communication, a wireless device communication, and a newspaper advertisement, and/or conveying a second chance identifier verbally via at least one of a telephone network, an advertisement, and a public address system. According to another embodiment of the invention, the outcome of the second chance win opportunity includes an entry into a sweepstakes, wherein a winning result of the sweepstakes includes at least one of an award, an incentive, and a benefit for the player. According to another embodiment of the invention, the second chance game interface includes an interface for tracking and managing sweepstakes entries.

According to one embodiment of the present invention, the system is configured to permit a player to accumulate sweepstakes entries. According to another embodiment of the invention, the system is configured to permit the player to select at least one sweepstakes game, from a plurality of sweepstakes games, to enter using accumulated sweepstakes entries. According to another embodiment of the invention, the system is configured to collect player information. According to another embodiment of the invention, the player information includes at least one of information associated with play of the primary game, play of the second chance game, activities performed by the player associated with the second chance game, player preferences, player affinities, demographic information, and personal information. According to another embodiment of the invention, the system is configured to generate a player profile from collected player information. According to another embodiment of the invention, the act of collecting player information includes acts of associating information on the primary game with a second chance identifier, and storing information on the primary game in response to access of the second chance game. According to another embodiment of the invention, the system is configured to associate non gaming activity with a second chance identifier, and store information on the non gaming activity in response to access of the second chance game. According to another embodiment of the invention, collecting player information includes accepting player information entered by the player. According to another embodiment of the invention, the system is configured to generate player preferences from collected information. According to another embodiment of the invention, the collected information is associated with an anonymous identifier. According to another embodiment of the invention, the system is configured to customize the second chance game to the player profile. According to another embodiment of the invention, the system is configured to customize the primary game to the player profile.

According to one embodiment of the present invention, customizing the second chance game to the player profile includes establishing the outcome of the second chance win opportunity to conform to a player preference or affinity identified at least in part by the player profile. According to another embodiment of the invention, customizing the second chance game to the player profile includes predicting player reaction to an incentive offer based at least in part the player profile. According to another embodiment of the invention, the system is configured to generate a player population profile, wherein the player population profile includes aggregate information from a plurality of players. According to another embodiment of the invention, the system is configured to identify a desired player activity, and establish the desired player activity as a qualification for participation in the second chance game. According to another embodiment of the invention, the desired activity includes the player visiting at least one of a select merchant, a gambling location, a gaming location, a partner location, and an affiliated location. According to another embodiment of the invention, visiting includes at least one of visiting an online site and visiting a physical location. According to another embodiment of the invention, the desired player activity further includes requiring the player perform a specific action at the visited location. According to another embodiment of the invention, the system is configured to tailor the desired player activity to a player profile. According to another embodiment of the invention, the system is configured to associate a plurality of second chance entries into a group, and permit the player to register the group of second chance entries.

According to one embodiment of the present invention, the system is configured to store player preference information with a player identifier. According to another embodiment of the invention, the player identifier includes an association with a frequent player club membership. According to another embodiment of the invention, the system is configured to permit access to at least one of a player status, accumulated second chance win opportunities, accumulated second chance wins, a plurality of second chance games, and status information associated with a plurality of second chance games outside the second chance game interface. According to another embodiment of the invention, the second chance game interface permits a user to view at least one of a player status, accumulated second chance win opportunities, accumulated second chance wins, and status information associated with a plurality of second chance games. According to another embodiment of the invention, the system is configured to continue at least one aspect of the primary game in the second chance game based at least in part on the second chance identifier.

According to another embodiment of the invention, the system is configured to enable new play of the primary game to continue one or more aspects of the secondary game. According to another embodiment of the invention, the outcome of the second chance game is determined before play of the second chance game. According to another embodiment of the invention, the outcome of the second chance game is determined during play of the second chance game. According to another embodiment of the invention, the outcome of the second chance game is determined based, at least in part, on collected or predicted player profile information. According to another embodiment of the invention, the second chance game includes at least one of an award, an incentive, and a benefit for the player. According to another embodiment of the invention, the incentive includes an incentive to obtain to obtain a second chance identifier, and at least one of the incentive, the outcome of the second chance game, and the award of the second chance game is determined, at least in part, by a desired action of at least one of the gambling establishment, a partner, an advertiser, and an affiliate.

According to one embodiment of the present invention, at least one of the incentive to obtain the second chance identifier, the outcome of the second chance game, and the award of the second chance game is determined at least in part by a matching desired player profile attribute with player attribute(s) desired by the at least one of the gambling establishment, a partner, advertiser, and an affiliate. According to another embodiment of the invention, any second chance incentives and awards are funded, at least in part, by at least one of affiliates, advertisers, and partners. According to another embodiment of the invention, any second chance incentives and awards are sponsored, at least in part, by at least one of affiliates, advertisers, and partners.

According to another aspect a method for collecting and managing player information in association with a second chance game is provide. The method comprises associating a second chance game with a player activity, requiring that a player of the second chance game be uniquely identified, providing a second chance game interface, permitting the player to play a second game through the second chance game interface, wherein the second chance game reveals an outcome of the second chance win opportunity, and storing player associated information using a unique identifier. According to one embodiment, the player activity includes at least one gambling activity, purchasing activity, entertainment activity, and work related activity.

BRIEF DESCRIPTION OF THE DRAWINGS

Various aspects of at least one embodiment are discussed herein with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by references signs, the reference signs have been included for the sole purpose of increasing the intelligibility of the figures, detailed description, and/or claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. In the figures:

DETAILED DESCRIPTION

According to one aspect of this invention, a player club is combined with one or more second chance games to dramatically improve the interactions between the gambling establishment and its players. The second chance games provide increased incentives for the player to participate in and interact with the player club, and the player club provides a greatly improved environment for playing the second chance games. This combination provides many benefits for both gaming establishments and their players.

Access to Second Chance Games

In one aspect of the invention, players must join the gambling establishment's player club in order to participate in the second chance game or games. This requirement creates a powerful incentive for players to join the player club and attempt to win or earn rewards or benefits offered by the second chance games. This helps gambling establishments to build and grow their player clubs and increase the number of participating players. The second chance games can serve as a recruiting tool to add players to the player club.

Figure 1:
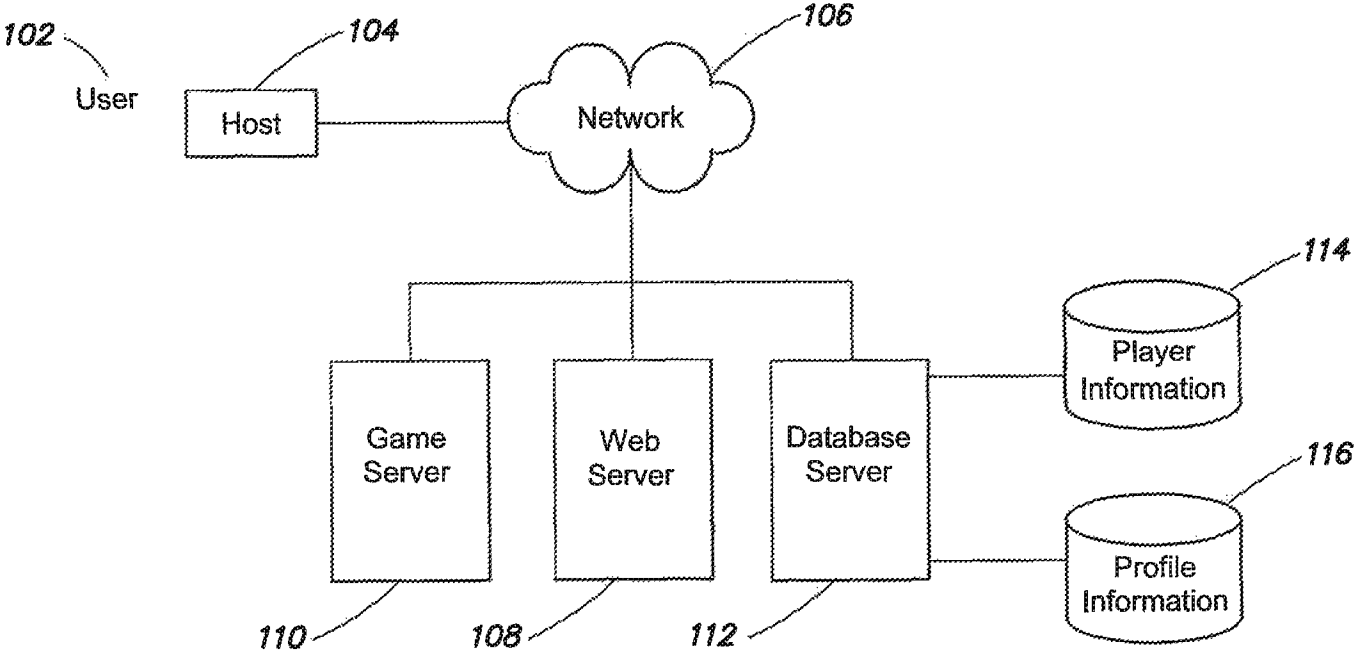
FIG. 1 is a block diagram of an example of second chance system, according to aspects of the invention.

In one embodiment, the player club and second chance games can be accessed online via a public computer network, a private network, the Internet, or some other computer network. For example, shown in FIG. 1 is an example system configured to permit a player to access a second chance game. The end user 102 can access a second chance game interface from a host computer 104. The host computer permits access to the second by connecting to, for example, web server 108 over network 106. Web server 108 can be configured to display a second chance web site in response to a browser program executed on the host computer 104 attempting to access the url for the second chance game interface. In some embodiments, the player must be a registered player of a player club in order to access the club and participate in the second chance games. In another embodiment, the player club and second chance games may be accessed physically at the gambling establishment, via a kiosk, at a partner of the gambling establishment, or at some other location approved by the gambling establishment. In one example, web server 108 can be configured to provide access directly to the second chance game interface. In another example, web server 108 provides on-line access to a player club system. The user/player 102 can access a second chance game interface from within the player club after providing authentication information to obtain access to the player club. For example, upon connecting to web server 108, a user interface can require the user to enter authentication information that is verified against information stored in the player club system, for example, on a player information database 114 accessed through database server 112. According to one embodiment, once the user 102 is identified, the user 102 can access any number of second chance games. For example, web server 108 can be configured to provide a display of selectable second chance games to the identified player by accessing game server 110. In FIG. 1, game server 110, web server 108, and database server are illustrated as separate components, however, servers 108-112 can be configured as components of one system. In another example, each server 108-112 can include one or more server systems that operate together to provide the services associated with servers 108-112.

In another example, user 102 has obtained a second chance identifier from play of a primary game. The user 102 enters the second chance identifier into the second chance game interface. In some settings, the second chance identifier may be linked to a specific second chance game that is displayed in response to entry of the second chance identifier. The user's activity with respect to the second chance games can be tracked, for example, by storing player activity information in database 114. User selection of games can be stored as part of a player profile in database 114. As is discussed in greater detail player affinities can be inferred from providing player choices and tracking the player's selection. In some embodiment, second chance identifiers can encode information on the underlying primary game. Primary game play can be stored either as part of a player information record (database 112) or as part of player profile information (database 114). In one alternative, the player profile database 114 can be accessed to determine what second chance games should be presented to user 102. For players with known affinities the second chance games opportunities can be tailored to that player's affinities. For example, the local baseball team can be identified for a given player, and second chance games provided with that theme. In another example, a player with multiple local teams, the player can be provided a choice of themes and each choice recorded to infer a preference of one team over another. Player information database 112 can also be used in determining player preference information, for example, a player's home address may be used in determining the local team to display. Databases 112 and 114 are illustrated separately in FIG. 1. However, one should appreciate that databases 112 and 114 can be implemented as one database. In one alternative, information illustrated as database 112 and 114 can be stored in multiple databases or other storage mechanisms.

If the player is not a registered player of the player club, the player can register online, at the gambling establishment, at a partner of the gambling establishment, at a kiosk, and/or any other location and via some method approved by the gambling establishment.

In another aspect of the invention, access to second chance games may optionally be limited to player club players who have completed one or more gambling plays. Access is gated and controlled by using some second chance indicator such as a code, symbol, or some other identifier from the gambling play(s). According to one embodiment, the purpose of the second chance indicator is to limit play of the second chance game(s) to players who have completed one or more gambling plays. The indicator requirement can be used in conjunction with the player club requirement with both conditions needed to be satisfied in order to fully participate in the second chance game. The indicator may optionally provide the player club system with details about the nature, value, type, time of use, place of purchase, location of use, and/or other details about the gambling play. As discussed in other aspects of this invention, this information about the gambling play may be stored as part of the player's player club profile.

In one embodiment, each gambling effort enables the player to participate in one or more second chance games. For example, if the gambling establishment is a lottery, the lottery may have a player club that is accessible online via the Internet. A player may purchase a lottery scratch ticket or lottery drawing ticket. The lottery ticket may contain a second chance indicator that enables the player to play a second chance game. Before the player can access and play the second chance game, the player must provide the second chance indicator. The player is then granted one or more plays in one or more second chance games. In another example, the gambling establishment may be a casino. If the player is playing slot machines or video poker, the player may receive a TITO ticket that contains a second chance indicator. Or, if the player is playing table games, a dealer, Pit Boss, host, or other gambling establishment representative may give the player a second chance indicator. As in the previous example, the player may then use the second chance indicator to access and play one or more second chance games.

Figure 3:
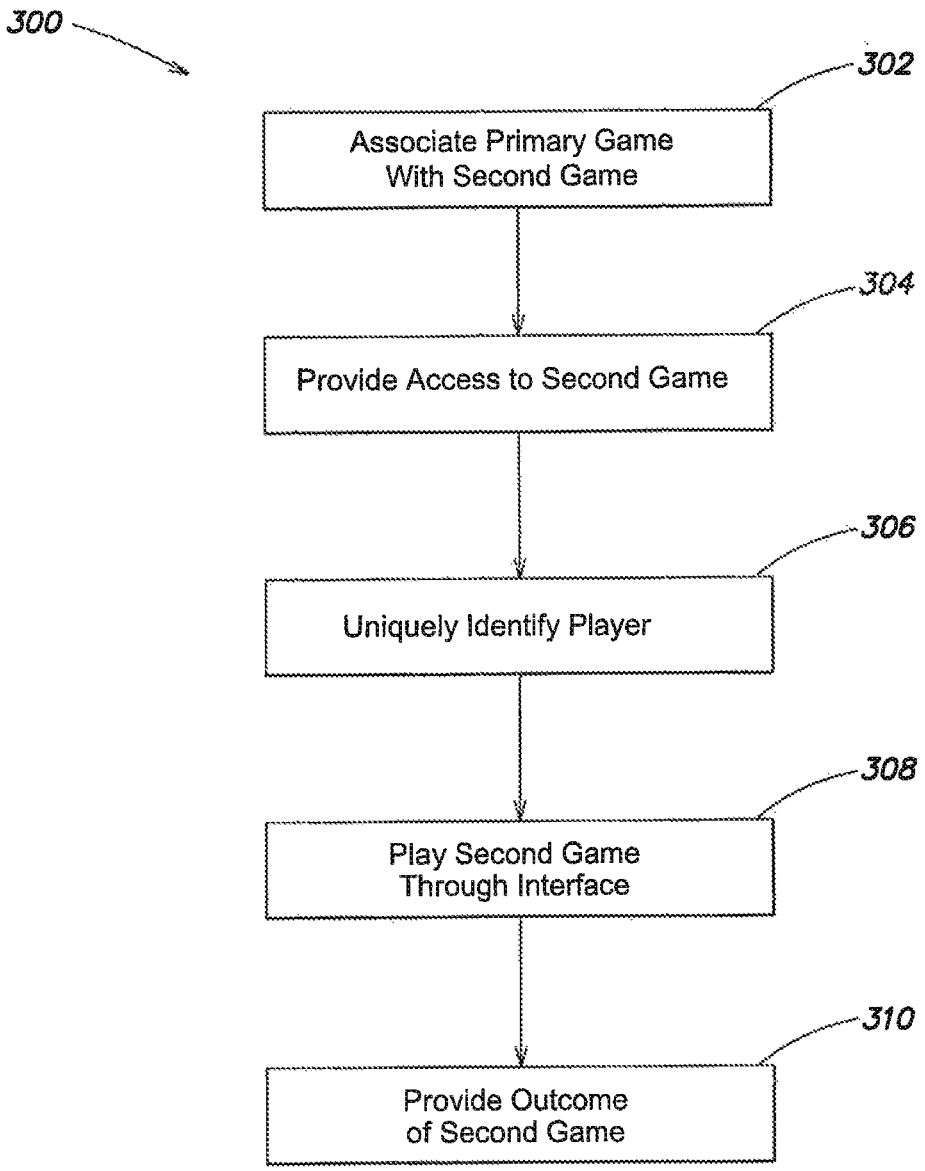
FIG. 3 is an example process for conducting a second chance game, according to aspects of the invention.

Shown in FIG. 3 is an example process for conducting a second chance game. Process 300 begins by associating primary game with a second chance game offer 302. Although, one should appreciate that different processes for conducting a second chance game may not require association with a primary game. In some examples, a second chance offer can be associated with non-gaming player activity. Further, in some examples, second chance offers can be associated with a player status. At 304 a player accessing a second chance game associated with the second chance offer. In one embodiment, information on how to access the second chance game can be provided on a primary game ticket, game piece, and/or receipt. The information can include, for example, a url to access a second chance interface online. At 306 the player is uniquely identified to a second chance game system. In one example, unique identification requires the player to enter a player club membership number into the second chance interface. In another example, the player can enter second chance identifier. In some examples, the second chance identifier can already be associated with a particular player and the entry of the second chance identifier alone is sufficient to identify the player. As discussed herein, the second chance game can include online and offline components. At 310 the outcome of the second chance game can be provided. In one example, the second chance interface can be configured to display an outcome of the second chance game. In another embodiment, the interface can be configured to provide instruction on any offline component of the second chance game that needs to be completed to obtain and outcome. Various combinations of online and offline primary and secondary games are contemplated. Co-pending U.S. Ser. No. 11/789,693 entitled "METHOD AND APPARATUS FOR CONDUCTING A GAME OF CHANCE," filed on Apr. 26, 2007, incorporated herein by reference in its entirety, discloses some examples of systems and methods for providing primary and secondary games with online and offline properties on which and in conjunction with some aspects of the present invention may be practiced.

In an another embodiment, all members in the player club may be eligible to play the second chance games, and no prior gambling effort or corresponding second chance indicator is required to play. However, a gambling effort and second chance indicator is required to redeem any prize or award or to enable any benefit won, earned, or granted through the second chance games. For example, the gambling establishment may be a lottery with a player club that is accessible online via the internet. Every member of the club may be able to play a limited or perhaps an unlimited number of second chance games each day, week, or other period. A player may win, earn or be granted one or more awards, prizes, or other incentives or benefits via the second chance games. However, to redeem the awards or otherwise enable the incentives or benefits, the player may need to enter a second chance indicator that can be found on a lottery ticket.

Those skilled in the art can appreciate that the outcome of the second chance games need not be determined by the specific second chance indicator. If the second chance indicator is not provided by the player until after the second chance game is completed, then the indicator has no affect on the outcome. But similarly, even if the second chance indicator is provided before revelation of the second chance game outcome, the specific outcome need not be determined by the specific second chance indicator. For example, the outcome of second chance games played online in a given day or other period may be determined at the time of login to the online system, before the player logs in, during second chance play, or at some other time; the second chance indicator required need not have any connection to the actual outcome, but merely serves to enable or qualify the player to participate in the second chance game(s) and/or redeem the outcome award or benefit.

It can also be appreciated that while second chance games are typically used only to add or create value to losing gambling plays, at the discretion of the gambling establishment the second chance games could be made available to either winning or losing plays. For example, if the gambling establishment were a lottery, the lottery could chose to allow players to play second chance games using either winning or losing scratch tickets, or even both. In another example, if the gambling establishment were a casino, the Pit Boss may award second chance plays to a very successful player in order to entice the player to join the players club and thereby allow the casino to send the player comps or marketing materials. The aspects, embodiments, and examples of this invention can apply equally whether using either winning or losing gambling efforts.

In another aspect of the invention, access to second chance games or redemption of second chance benefits may be made available by other methods in addition to or instead of winning or losing gaming plays. For example, access to second chance games may be provided via second chance indicators found on retail receipts, sporting event tickets, direct marketing mailings, newspaper advertisements, or numerous other sources. The various aspects and embodiments of this invention are applicable to all types of second chance play, no matter the source of the second chance indicator used to gain access to the second chance games or used for redemption of second chance benefits.

Figure 4:
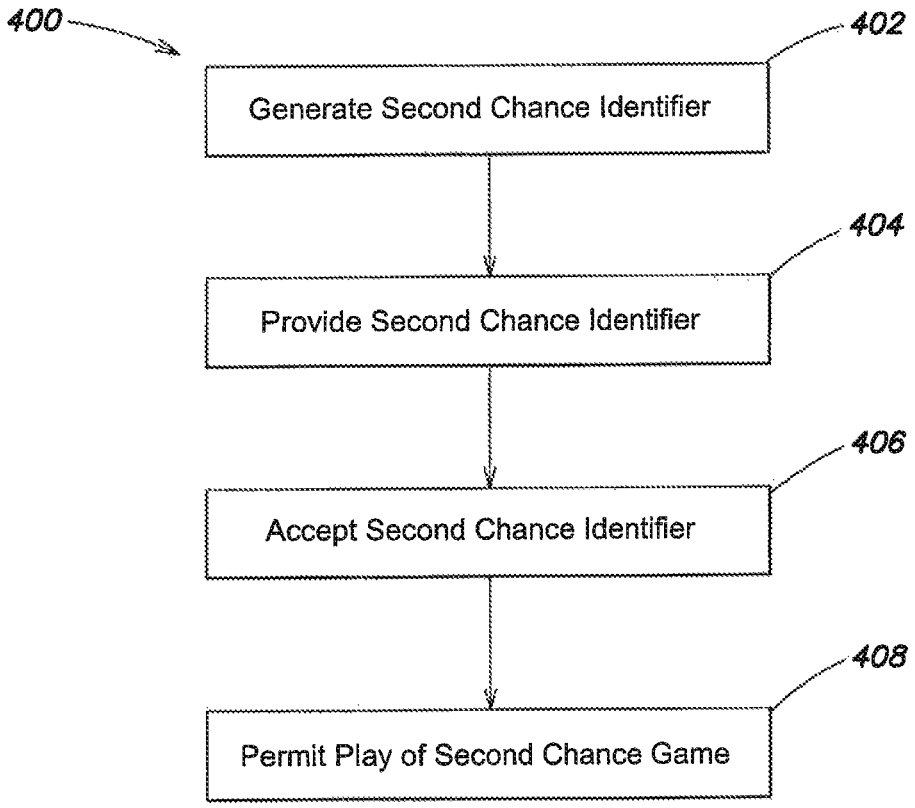
FIG. 4 is an example process providing access to a second chance system, according to aspects of the invention.

For example, FIG. 4 shows an example process 400, for providing access to a second chance system. Process 400 begins at 402 with the generation of a second chance identifier. The second chance identifier can be associated with predetermined benefits or in one alternative can be associated a benefit that is determined upon access to a second chance game system. In another alternative the second chance benefit can be determined once the second chance game is complete. In one example, teaser benefits can be presented with a second chance identifier, so that a player is made aware of a range of possible values associated with a particular benefit. As discussed, the actual benefit may be predetermined, determined on entry, determined on completion, as some examples. The second chance identifier is provided to a player at 402. In one example, a player receives the second chance identifier in conjunction with play of a primary game. In another example, the second chance identifier is provided in conjunction with purchasing activity at a non-gaming point of sale location. In another example, a second chance identifier can be provide to a player based on status information associate with the player and can include membership in a player's club, for example.

Once the player has the second chance identifier, the player can participate in second chance games. At 406, a second chance system accepts the second chance identifier. For identifiers that are not associated with a specific benefit and/or identifiers that have not provided an indication of the specific value (which can include teaser benefits) the value of the benefit may be determined upon entry of the second chance identifier. The value can be displayed to the player at that time, or at later time. In some examples, after play of a second chance game. Once the second chance identifier has been entered at 406, player of the second chance game is permitted at 408. Permitting play can include a requirement that the player provide authentication information. In another example, prior to permitting play, a player can be required to enter information in an interface of the second chance system. The second chance system can be configured to required entry of player identifying information to uniquely indentify and/or authenticate the player. In another example, the player can be prompted to input personal information that can be associated with a player profile in order access the second chance game itself.

It can be appreciated that simplified and more cost effective fulfillment is a significant advantage of this method of second chance play. Traditional second chance games require fulfillment via mailed coupons, forms, index cards, or other methods that are cumbersome and time consuming for both players and the gambling establishments. By providing second chance games via the player club, the process is simpler, faster, and more cost effective for all involved.

For example, in a lottery setting second chance offers are conventionally tied to specific games. For example the known Deal or No Deal game has been employed as a theme for many game implementations both in the casino space and in the lottery space. Each game can require its own independent second chance opportunity, thus increasing the burden on a player wishing to play and/or redeem second chance opportunities. In some conventional settings, each second chance opportunity requires its own registration and participation process. In one embodiment, a global second chance registration is available permitting players to register once for any number of second chance opportunities. In another embodiment, one registration is enabled across multiple games and/or multiple second chance sponsors. Second chance win opportunities are used in both lottery settings and casino settings. Providing access to both types of opportunities with one registration minimizes inconvenience for participating players and increases the overall likelihood that a player will participate in the second chance game.

Some examples of systems and methods for providing bonus games, player club tracking, and referral network operation are disclosed in co-pending U.S. application Ser. No. 12/238,849 entitled "METHOD AND APPARATUS FOR PROVIDING PLAYER INCENTIVES," filed on Sep. 26, 2008, which application is incorporated herein by reference in its entirety. Such bonus games and tracking (player and referral) operations can be employed in conjunction with some aspects of the present invention.

Increased Player Club Participation

As discussed, requiring players to join the player club in order to participate in second chance games provides a strong incentive for players to join the player club. This helps the gambling establishment to attract players to the player club and thereby grow the size of their player club. But in addition to helping the gambling establishment increase the number of players in their player club, the second chance games also provide the player club an increased level of interest and excitement that helps the gambling establishment increase the level of engagement and active participation in the player club.

In one aspect of this invention, the player club provides multiple second chance games via the player club. When engaging in second chance play, players may choose which games are most engaging to them personally. As compared to traditional second chance games, this variety of game content combined with player choice greatly improves the player club experience, enjoyment, and participation.

In one embodiment, the player is given game credits that allow the player to play second chance games. These credits may be given to the player when the player enters one or more second chance indicators that were obtained from gambling plays or other sources. Alternatively, the credits may be given to players at some regular interval or for some special occasion or event or for some other reason chosen by the gambling establishment. The player may then use the second chance credits to play any available second chance games of his or her choosing. It can be appreciated that both methods of obtaining second chance credits may be used within the same player club.

For example, a lottery gambling establishment player may purchase scratch tickets, and each scratch ticket may contain a second chance indicator that gives that player 10 credits towards playing second chance games. In another example, every player club player may be given 20 second chance game credits per day.

In another embodiment, the player is given a yet-to-be-revealed number of second chance play credits. This number of plays may be predetermined or it may be calculated at the time of player club access via a pay table, random number generator, or some other method. According to some embodiments, the player must access the player club to reveal how many plays the player has been given. This provides an additional incentive for the player to access the player club system. For example, a lottery player may receive a second chance indicator via a Keno ticket, and may be told that the player has been granted between 5 and 70 second chance play credits. The player must access the player club and provide the second chance indicator in order to reveal the number of credits.

Again, the number of credits may or may not be predetermined, and the number of second chance credits awarded to the player need not be determined by the second chance indicator. For example, it may be predetermined by the player club system that on a given day, the player will receive 50 second chance credits for the first second chance indicator provided, 10 credits for the next 3 second chance indicators, and 30 credits for all subsequent second chance indicators provided.

While the variety of second change games and content will improve the success of the player club, one can appreciate that the type, method, and/or value of the second chance outcomes can improve the player club even further. Both the rewards offered by the second chance games and the manner in which they are awarded will increase a player's motivation to participate in the player club, play the second chance games, and engage and interact with the gambling establishment and brand.

Figure 2:
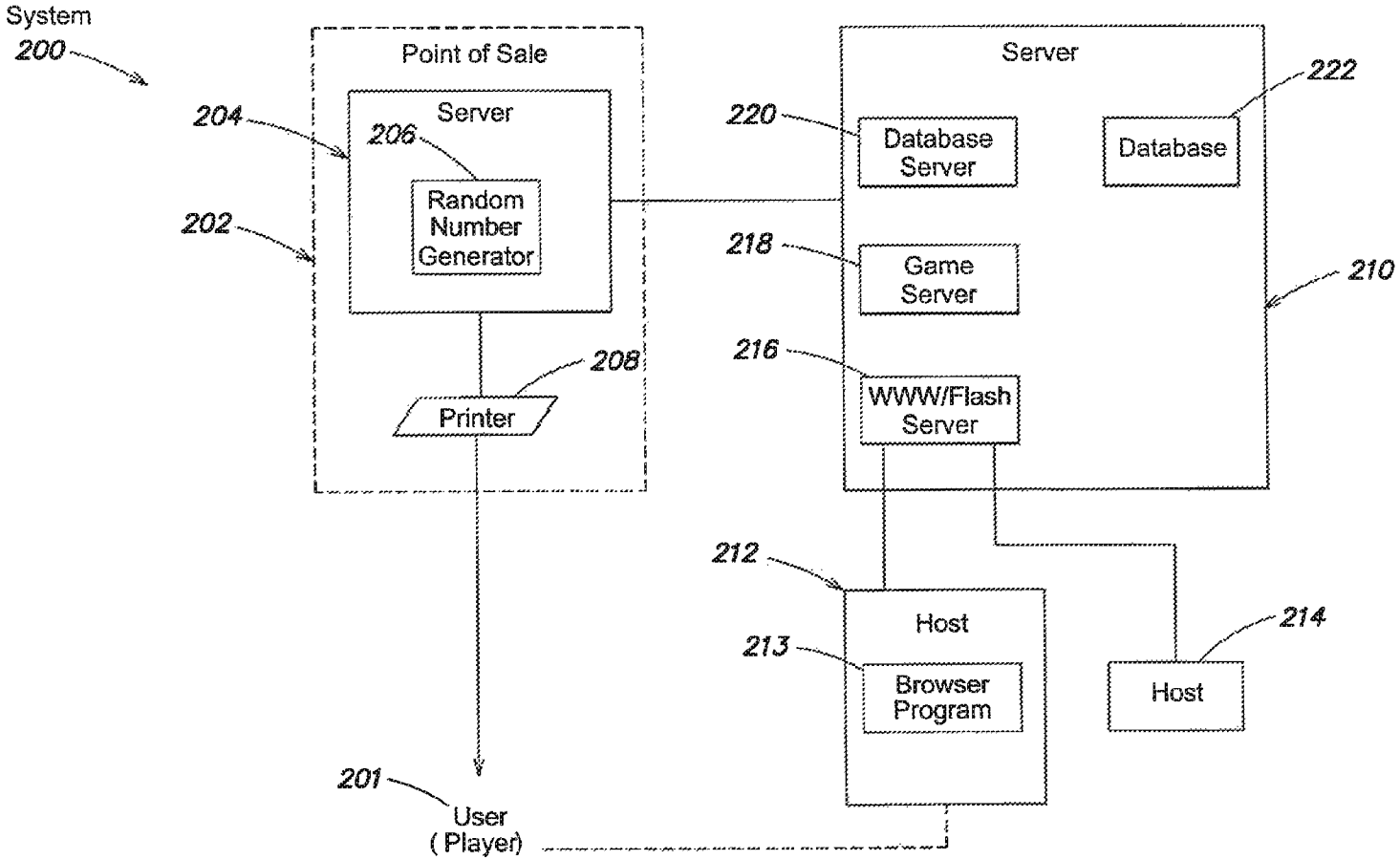
FIG. 2 is a block diagram of elements of example second chance system including point-of-sale elements, according to aspects of the invention.

Shown in FIG. 2, is an example system 200 for providing a primary game from a point of sale location that can be associated with a second chance game available on-line. Ticket entries printed in response to play of a primary game with a primary win opportunity can be provided in association with a second chance game identifier. For example, a purchase of a lottery ticket by a player 201 at the point of sale location can be used as a qualifying event for an online second chance game provided by second chance server 210. The player can participate in any authorized gaming at location 202. In response to a player request, point of sale sever 204 can trigger generation of an entry into a primary game. The entry can be generated using a random number generator 206 executed on server 204, or in one alternative the entry can be generated from a pool of tickets. In another alternative, an order for ticket generation can be predetermined and replayed upon receiving request. In another example, the tickets themselves are predetermined. Printer 208 can be configured to print tickets in response to a participation request regardless of the nature of the entry being provided (predetermined or randomly generated). In addition to printing an entry into the primary game, point of sale server 202 and printer 208 can be configured to provide a second chance identifier on the entry for the primary game. In one alternative, the point of sale location does not need to be a gaming location. For example, the point of sale location can also be simply a market, store, or other location. In some embodiments, printer 208 can be configured to print a second chance identifier on a purchase receipt and/or other record associated with the user's activity at the point of sale location.

According to one embodiment, the point of sale server 202 can be linked to a second chance server 210. Point of sale server can communicate information associated with activity performed by the user 201 at the point of sale location. For example, the point of sale server can communicate information about a primary game in which the user participated. In one example, this can include information about scratch ticket play (denomination, etc.). In another example, the information communicated can include purchase activity and/or other activity. In some embodiments, rather than communicate this information directly, the information associated with the user's activity can be encoded in the second chance identifier. Further second chance server 210 can be configured to request this information from the point of sale server 202 in response to a user 201 participating in a second chance game. For example, a user 201 can enter a second chance identifier in a browser program 213 executed on a host computer 212 to access a second chance server 210.

Second chance server 210 can be configured to provide access to a second chance game. Further second chance server 210 can be configured to provide player's club service, including registration and or player's club account maintenance, etc. In one alternative, second chance server can be connected to additional systems that host a player's club service (not shown). User 201 can access a web server 216 by entering a url in the browser program 213. The url can be provided, for example, as part of the second chance identifier. In some examples, a url can comprise the second chance identifier. In one embodiment, the accesses the web/flash server 216 which renders a user interface on the host computer 212. The user interface can be configured to require entry of indentifying and/or authenticating information in order to permit access to the second chance game. In another embodiment, the user 201 is required to be uniquely identified to the second chance system in order to participate in second chance games. Unique identification can include a membership to a player club. In other embodiment, unique identification can include an anonymous identifier associated with the user 201. Preserving user anonymity and permitting collection of information can be advantageous, as discussed in greater detail, herein.

Once identified second chance server can be configured to permit access to secondary chance games. For example, second chance games can be stored on game server 218 and provide upon user request. Game server 218 can be configured to host multiple games. Further web/flash server 216 can be configured to present a user interface permitting user selection of the multitude of second chance games, a subset of games, individual games, and/or only games for which the user is qualified. Information on game qualification can be stored in database 222 accessed through a database server 220. Further information on user activity from the point of sale location can be stored in database 222 and/or associated with a player profile. In one example, anonymous identifiers can be stored in database 222 and user activity can be associated with the anonymous identifier. In another embodiment, the communication between the point of sale sever 202 and second chance server 210 permits, point of sale activity to be directly tailored to a particular player. For example, a user/player 201 who is a member of a player club can have a player profile associated with the player club membership accessible by the second chance server 210. The player club membership can be reflected on a player club card. In one example, the player club card includes machine readable information permitting the point of sale system to retrieve information associated with the membership. As discussed in greater detail herein, that information can be used to tailor a primary game to the preferences of the player. Additionally that information can be used to provide additional information on a receipt or game play printed from printer 208 and/or to target additional sales. In some settings a player card can be configured to be associated with a player's profile but still prevent specific identification of the player.

In another aspect of the invention, the second chance game or games may allow the player to win or earn entries into a sweepstakes, contest, or drawing in which the player may win a prize or other incentive. The player may be able to view their number of entries relative to the total number of entries accumulated by all players in the club. Through continued second chance play, the player may be able to earn additional entries. This type of second chance outcome and reward provides an entertaining and engaging experience for the player that will increase interest and participation. For example, the player may see that they have accumulated 500 entries in the "$10,000 Monthly Sweepstakes" drawing, and that the accumulated entries of all other members total 223,000. This may provide the player with additional incentive to participate and earn more entries so that the player can improve their odds of winning the sweepstakes prize.

Similarly, in another aspect, the gambling establishment may offer multiple sweepstakes, contests, or drawings with different prizes or other incentives and/or different drawing dates. As the player wins or earns entries via the second chance game or games, the player may allocate the entries towards the sweepstakes, contests, or drawings of his or her own choosing. The player may allocate the entries immediately upon receipt, or the player may accumulate and keep the entries and allocate them at some later time. These "banked" entries may or may not expire at some point in time.

The player may also be able to view the number of total entries from all participants in each sweepstakes, contest, or drawing, and may also see their own number of entries. For example, the player may see that they have accumulated and allocated 500 entries in the "$10,000 Monthly Sweepstakes" drawing and 250 entries in the "Trip for Two to Las Vegas Sweepstakes", and that the accumulated entries of all other players total 223,000 and 350,000, respectively. This may provide the player with additional motivation to participate because the player can customize the incentives to their personal interests as well as strategize about the best place to allocate entries.

Another aspect of the invention allows the player to earn entries into self-renewing sweepstakes. These self-renewing sweepstakes are not drawn on a specific date, but instead are drawn when a certain number of total entries is reached. Once the sweepstakes ends, a new sweepstakes begins. Rather than having to allocate the sweepstakes entries immediately, the player is allowed to accumulate the entries and allocate them at a time of his or her choosing. This enables the player to allocate the entries into a sweepstakes at a time when it might be most advantageous to the player. For example, if a particular sweepstakes automatically draws and renews every time the number of entries reaches 100,000, the player may wait to accumulate 10,000 entries and then allocate them to the sweepstakes. This would give the player a 1 in 10 chance of winning. The novelty and strategy of such a self-renewing sweepstakes enhances the player's interest and participation in the player club.

Some examples of systems and methods for providing bonus games and/or sweepstakes and tracking their redemption are disclosed in co-pending U.S. application Ser. No. 12/433,435 entitled "METHOD AND APPARATUS FOR PROVIDING PLAYER INCENTIVES," filed on Apr. 30, 2009, which application is incorporated herein by reference in its entirety. The bonus and/or sweepstakes games disclosed can be employed in conjunction with some aspects of the invention.

In another aspect, rather than awarding sweepstakes entries, the second chance games may reveal prizes, awards, and/or benefits directly upon completion of second chance play. For example, a player may complete a second chance game be awarded a T-shirt, a complimentary hotel stay, another 20 second chance game play credits, a social networking widget, or some other prize, award, or benefit.

Another aspect of the invention allows the second chance games to act as an extension of the originating gaming experience. This extension may be an extension of the theme of the game, or it may be an extension of the gaming play itself, or it may extend both. The extension may then continue back to the originating gaming experience, and may continue to extend back and forth between the originating and second chance experiences.

In one embodiment, the theme of the originating game is extended into the player club second chance games. This may include the branding of the game and/or the actual game play itself. Upon completion of second chance play, the gaming experience could continue back on the originating casino game. Play could then continue back to the second chance games, and this cycle could continue indefinitely.

For example, a casino gambling establishment player may play a slot machine themed with a brand from a favorite television show. During the course of game play, the slot machine may advance a story line involving the television show characters. Upon completing the slot machine play, the player may receive a TITO ticket with a second chance indicator that allows the player to see and experience the continuation and/or climax of the story line during play of a second chance game available via the player club. The second chance game could provide an indicator, code, or other identifier that could be used to further continue the story line and related gaming experience back on a slot machine. This cycle could continue indefinitely, with the story line continuing between the casino slot machines and the player club second chance games.

In another embodiment, the gaming play itself may continue via the second chance games, with the second chance game extending the actual gaming play, including the gaming pay table. For example, a lottery gambling establishment player may purchase a $5 lottery scratch ticket at a retail point of sale location. The lottery ticket may include $3 worth of play on the scratch ticket itself. $2 worth of play may then be available via second chance game available via the player club. In another example, a $5 gaming ticket may be purchased at a casino and the entire gaming play occurs via a second chance game in the player club. In another example, a player could pay $1 to extend a losing $5 lottery ticket and enable it to be played via a second chance game.

It can be appreciated that these embodiments could be combined, and a second chance game could extend both the theme or storyline and the gaming play of an originating gaming play.

In another aspect, the second chance game may enable the player to accumulate points in the player club. Some player club benefits or awards may then be available only to players who have accumulated a certain threshold of points.

In one embodiment of this aspect, a player club may have multiple membership levels, with a player's level determined by the accumulated number of player club points. This accumulation of points may be during a specific period of time or during the entire lifetime of membership. Certain benefits of the player club may be available only to members who have achieved a certain status in the player club.

For example, a player club may have 3 levels of membership: silver, gold, and platinum. All new players may automatically be granted silver status, while players must accumulate 10,000 player club points during a consecutive 12 month period to qualify for gold membership, and 20,000 points to qualify for platinum membership. Gold status members may have certain benefits not available to other members, such as an expanded catalog of second chance games that are not available to silver status players. Or, gold status members may receive a special newsletter or special offers and promotions, or some other benefits. Or they may be able to customize the appearance and functions their online player club access. It can be appreciated that many types and levels of benefits could be conferred to members who achieve certain levels of club status, and that multiple types of benefits may be combined and provided as a group of benefits.

In a related embodiment, the player may be able to view status and accumulated points relative to other players and may be given a corresponding ranking visible to all players in the club or possibly even people outside the club. For example, the club may include a "leader board" page that shows the top ranked players. Or, the names and ranks of top players may be published or promoted outside the club by the gambling establishment. Similarly, a player's status or standing could be displayed via some other mechanism, such as a bumper sticker, a T-shirt, or a widget on a social networking web site.

In another related embodiment, points may additionally or alternatively be accumulated for a specific game or games, rather than for the player club in general. For example, a player may have the most overall "club" points and be ranked #1 in the club, and/or or they may have the second most points in the "Texas Hold'em Poker" game and be ranked #2 at "Texas Hold'em Poker."

In another related aspect, player club status and/or levels and the corresponding benefits are not tied to accumulation of points but are instead related to the aggregate amount of money wagered through the gambling establishment. For example, gold player club status may be achieved by wagering $500 during any consecutive 12 month period. In another example, wagering over $1,000 during the lifetime of player club membership may give the player permanent platinum level status.

Another related aspect sets the player club status and/or levels and the corresponding benefits based on length of time a player has been a member of the player club. For example, all active players may achieve gold player club status after 6 months of membership in the player club.

Those skilled in the art can appreciate that player club status and/or levels and the corresponding benefits may be tied to numerous other metrics or a combination of metrics. It can further be appreciated that the benefits made available to players via achievement of specific status and/or level can serve as an effective incentive to increase player club participation and gaming establishment engagement. The benefits may be tangible benefits, such as the ability to play certain second chance games or certain versions of second chance games. Or, the benefits may be more intangible, such as the personal satisfaction and enjoyment derived from achieving the #1 ranking on the Texas Hold'em Poker leader board.

It can be appreciated that these aspects and embodiments may be combined. For example, certain sweepstakes may be available only to players who have accumulated enough points to earn a specific member status or gain some other benefit. Using the above examples, it's possible that only "gold" status players would be allowed to allocate entries to the "Trip for Two to Las Vegas Sweepstakes." Non-gold status members may only be allowed to allocate entries to the "$10,000 Monthly Sweepstakes"

One skilled in the art can appreciate that there are many embodiments that can be similarly used for second chance play. These include a wide range of second chance games and other reveal concepts.

Building Player Profiles

In another aspect, the gambling establishment can use the increased player interaction to gather information and data about the player that can be used to build a player profile. This data may be gathered or inferred from various sources.

In one embodiment, some data may be self-reported by the player, and the player club may provide a mechanism for the player to provide and update this profile information, which might include demographic data, preferences, or other information.

To collect data about the player, the player club may provide surveys that can be used to gather additional profile information. The collected survey data may be directly self-reported. For example, the survey may ask "What is your favorite leisure activity: travel, sports, gambling, reading, music, movies?" The survey data may also be used indirectly to infer additional profile information. For example, the player may be given a choice of several surveys to complete. If the player chooses a sports or travel related survey topic, it could be inferred that the player has an affinity to sports or travel.

In another embodiment data is gathered or inferred from the player's interactions with the player club and/or the second chance games. This might include collection of player affinities, predispositions, preferences, or other data about the player. For example, a player who is asked to allocate awarded sweepstakes entries and chooses to primarily allocate them to various vacation trips may have an affinity for travel, while a player who allocates entries to win tickets to sporting events likely has an affinity for sports. In another example, a player may be entering second chance indicators from lottery scratch tickets. If the scratch tickets are predominantly those branded with a regional baseball team, the system may infer that the player has a strong affinity to that baseball team.

It can be appreciated that interactions used to gather information may not be related directly to gambling efforts. Information may be gathered or inferred from all direct and indirect interactions. Some of these interactions may be with related, affiliated, or non-related establishments, such as retail chains, websites or other entities. For example, a player may interact with the player club by using a URL, a second chance indicator, a promotion code, or some other information obtained from a receipt from a home improvement or hardware store. In this case, the system may infer that the player has an affinity towards home improvement or repair. Similarly, the player may interact with the player club by following a specific URL, using a second chance or promotion code, or by using some other information from a sports team website. In this case, the system may infer that the player has an affinity for that sport and that sports team.

In one aspect, profile information can also be gathered regarding the player's frequency of play, level of play, type of play or other gaming profile information.

In one embodiment of this aspect gaming profile information may be gathered directly at the time of play or point of sale. For example, a lottery player may provide their player club information at the time they purchase lottery plays, and the system can thereby track the level and frequency of play.

Another embodiment of this invention also allows gaming profile information to be gathered indirectly via the player's interaction with the player club. For example, in the case of a lottery gambling establishment, as the player enters the second chance indicators of play from gaming efforts, the player system can know the denomination and type of lottery play associated with each indication, and consequently the system can tally the types and value of the plays to estimate the player's frequency, level, and/or type of play.

This embodiment allows the gambling establishment to determine a player's worth indirectly by proxy rather than by the traditional direct methods. Traditionally, some player clubs—for example those used by some casinos—are only able to determine a players worth directly at the time of gaming play. This ability to determine worth by proxy is very valuable to gambling establishment that are unable or unwilling to determine worth directly by traditional methods. For example, a lottery gambling establishment can typically not track players during the time of game play. But over a period of time lottery player may gain access to second chance games by using a combination of $1, $2, and $5 scratch tickets and $1 lottery drawing games. The player club system could tally the total value of tickets purchased and thereby indirectly estimate the frequency, level, and type of play for that player and thereby determine the player's worth.

Figure 5:
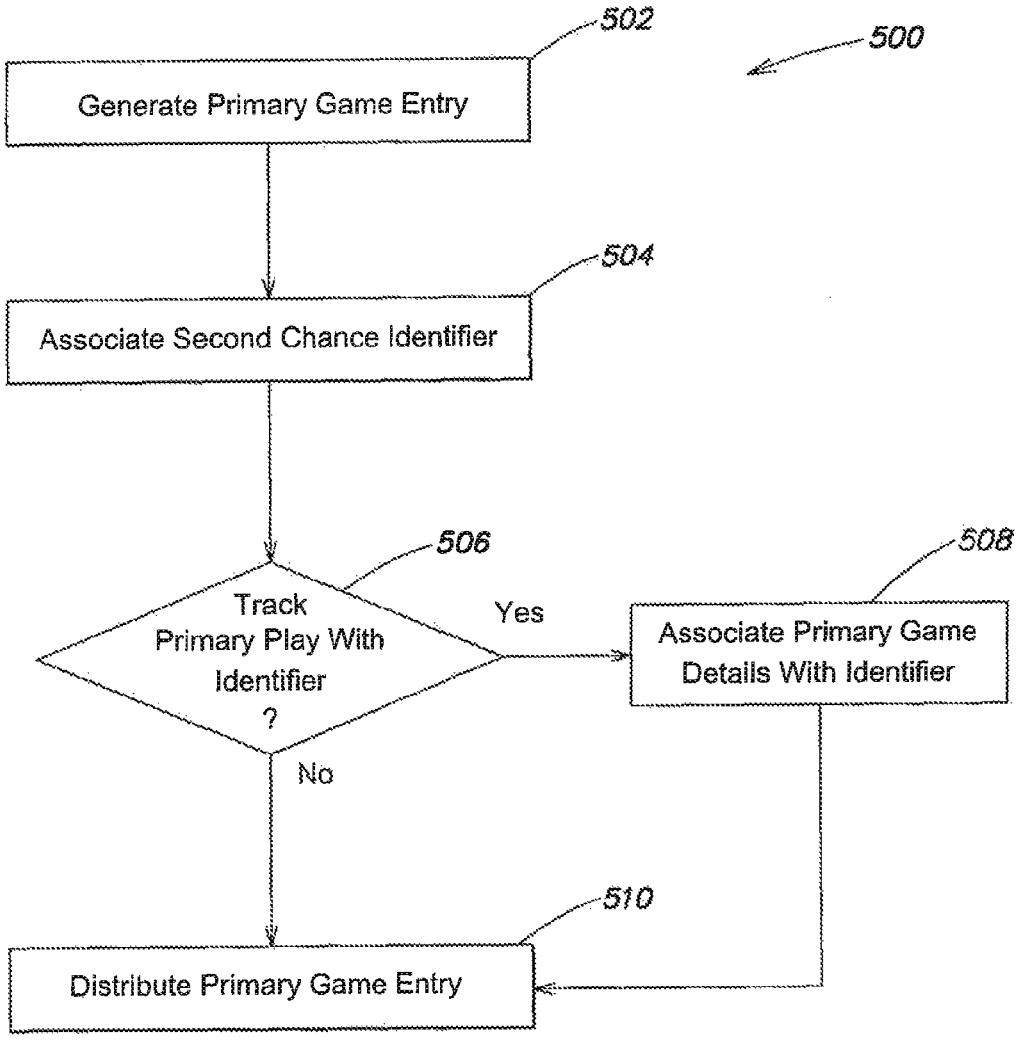
FIG. 5 is a an example process for conducting a second chance game, according to aspects of the invention.

Shown in FIG. 5 is an example process 500 for conducting a second chance game. At 502 a player requests participation in a primary game and an entry for the primary game is generated. The primary game can be of any variety as discussed herein. In one example, the primary can include a lottery drawing game and/or scratch ticket games. Each game instance is associated with a second chance identifier at 504. The identifier can be printed on the entry itself. In one alternative, a preexisting identifier on the primary game entry can be linked to a second chance game entry and that information communicated to a second chance game system at issuance. In another alternative, the second chance identifier can be incorporated into the generation process of primary game entries, including for example generation of scratch tickets. For embodiments wherein tracking of primary game activity is desired 506 YES, the primary game details (purchase price, game, game style, game theme, duration of game if applicable, as some examples) are associated with the second chance identifier. In one example, the primary game detail can be encoded in the second chance identifier. In another example, the details associated with the primary game can be communicated to a second chance game system with the second chance identifier and the game details can then be associated with the player. In one example, the game details are associated with the player upon the player's entering the second chance identifier in the second chance game system. For embodiments where primary game information is not desired 506 NO and embodiments where tracking is desired 506 YES, the primary game entry is distributed to players at 510. Another aspect allows for player information to be gathered from third parties. In one embodiment, information about the player may be purchased from a third party provider or service and added to the player's profile. For example, a gambling establishment may identify a player via the player club and may then purchase financial information regarding the player from a credit reporting bureau. Another service may provide the gambling establishment with additional information, such as the player's phone number, the model and make of the player's car, the purchase price of the player's home, and/or other information that may help build a more complete player profile.

Some examples of systems and methods for collecting player information are disclosed in co-pending U.S. application Ser. No. 12/345,289 entitled "SYSTEM AND METHOD FOR COLLECTING AND USING PLAYER INFORMATION," filed on Dec. 29, 2008, which application is incorporated herein by reference in its entirety. Such player information collection methods and systems can be employed in conjunction with some aspects of the present invention.

Building Anonymous or Otherwise Limited Player Profiles

Typically, a player club requires players to provide a drivers license, photo identification, or some other proof of identity. Typical information required to be collected to allow entry into the player club includes name, address, city, and zip code and often additional demographic information. However, it can be appreciated that some gambling establishments may be unable or unwilling to collect personally identifiable information regarding the members of their player clubs. For example, an online poker gambling establishment may not have any reliable method available to confirm a person's identity. In another example, a lottery may sell gaming plays via kiosks, vending machines, convenience stores, or other points of sale that do not collect personally identifiable information. In another example, a lottery or other gambling establishment may be able to collect personally identifiable information, but it may nonetheless elect to keep its players anonymous because the gaming establishment wishes to avoid the perception that it is redlining, selling in socio-economically challenged areas, or pursuing some other undesirable goal or methodology. In yet another example, players may demand anonymity for any number of reasons, such as, for example, fear of identity theft, lack of trust in the gambling establishment, privacy concerns, or some other reason.

In another aspect of this invention, either the gambling establishment or the player or both may elect to limit the quantity and/or type of information that is gathered.

In one embodiment, the player's personally identifiable information, address, and/or other demographic information may not be collected and the player may thereby remain anonymous. For example, the player club system could be customized to keep the player's identity anonymous and instead collect any of a player's behavioral, preference, frequency, spend, player worth, and/or other data In another embodiment, the player club may gather only demographic, behavioral and/or type of play data but may not collect frequency of play, spend or player worth data.

One skilled in the art can appreciate that the system could be configured to gather or ignore any level or type of information, as desired by a particular gaming establishment, player, or both.

Using Profile Information for Player Interactions

Another aspect of the invention uses gathered player profile data to build a model of the player that can be used to make observations and predictions about the player's value, preferences, affinities, predispositions, future behavior, and/or other profile or model data or attributes. This information can then be used to customize and/or improve all interactions with the player and thereby make it more likely for the gambling establishment to successfully advance its goals.

In one embodiment, the player's interaction with the player club and gambling establishment can be customized to fit the observed or predicted affinities, preferences and predispositions of the player, thereby increasing the likelihood that the player will enjoy the experience and increase and sustain interaction with the player club and the establishment. For example, if the system infers or observes that the player has an affinity to a regional baseball team, the player club can theme the player interactions with the baseball team brand. In this case, mailings to the customer may use baseball themed artwork, the online player club experience for this player may be themed in the team colors, and the available second chance games may have baseball themes. It can be appreciated that many forms of customization can be applied to all the interactions with the player, and that these customizations will likely increase the players enjoyment and thereby increase the players interaction with the player club and the establishment.

In another embodiment, observations or predictions of the player can be used to target specific marketing efforts to the player and thereby increase the likelihood that the player will respond positively. For example, if the system predicts or observes that the player has an affinity for travel to warm locations, the system may target the player with marketing offers from Caribbean hotels.

Another embodiment uses the predictions and observations of the player to select the type and value of incentives offered to the player, thereby making it more likely that the player will accept the incentive. For example, if the player has an observed or predicted affinity for cooking, the incentives offered may be a signed cookbook or entries into a sweepstakes to win a cooking class with a famous chef. If the player's profile observes or predicts a very high player worth, the gambling establishment may elect to give the player an expensive set of cookbooks rather than a single, less expensive book.

One skilled in the art can appreciate that many other embodiments exist in which the modeled observations or predictions about the player can be used to improve and/or customize interactions with the player and thereby increase the likelihood of advancing numerous other goals of the gambling establishment. These and other embodiments may be combined to maximize the likelihood that the gambling establishment will achieve its desired goals. For example, marketing messages may be targeted based on player preferences and the messages themselves may be customized to match the player's affinities.

Furthermore, it can be appreciated that goals to be advanced by the gambling establishment may come directly from the gambling establishment, they may come from affiliated or non-affiliated third-parties or other entities, or they may come they may be goals shared by both. In the case of affiliated or non-affiliated third parties or entities, the gambling establishment may directly or indirectly provide player profile data and model observations or predictions directly to the entities or the gambling establishment may provide such information as a service.

Using Profile Information in Aggregate

It can be appreciated that not all gambling establishment players will join the player club. The percentage of overall player participation may vary depending on the establishment. Another valuable use of the player club information is to help the gambling establishment better understand its players, products, campaigns, messaging and/or other aspects of the gambling establishment. This improved understanding can be used to improve the gambling establishment's interactions with all players, including those who are not part of the player club.

In one aspect of this invention, player club information is aggregated across all players to make observations and predictions about the preferences, affinities, predispositions, future behavior or other player model information that can be applied to all players inside and outside of the player club.

These observations and predictions can be used to increase the likelihood that the gambling establishment can achieve its goals.

In one embodiment of this aspect, the gambling establishment may use aggregate information, observations, and predictions about the player club members to make decisions about the gambling establishment's product mix and product development. For example, a lottery gambling establishment may observe that player club members passionately support the regional baseball team and correspondingly they particularly enjoy gambling and/or second chance games with themes that relate to the team. The lottery may therefore decide to create a new scratch ticket that incorporates the baseball team theme, instead of creating a new scratch ticket that uses a horse racing theme.

In another embodiment, the gambling establishment may use aggregate information, observations, and predictions about the player club members to make decisions about marketing campaigns and messaging for all its players inside and outside the players club. For example, a casino gambling establishment may observe that its player club players frequently access second chance games using second chance indicators from gaming plays on slot machines themed with a certain television show, and those players frequently play similarly themed second chance games. When creating a new billboard or radio advertisement, the casino may therefore infer that all its players and potential players may enjoy this same television show, and the establishment may therefore elect to create an advertisement with the television show theme.

Those skilled in the art will appreciate that such aggregate information may be particularly beneficial for gambling establishments that do not have the ability and/or desire to closely track and/or observe its players during gaming play or other interactions. For example, a lottery gambling establishment typically has very little access and interaction with its players beyond the point of sale transactions where lottery plays are purchased. While the lottery may make use of focus groups, surveys, or other methods to better understand the preferences and predispositions of its players, aggregate player club information would provide another very valuable source of information about its products, campaigns, and messaging.

Incentivizing Players to Take an Action

In one aspect of the invention, the player is provided an incentive to take a certain action that is desired by the gambling establishment. This incentive may be tangible or intangible and may be overtly offered as an incentive, or it may be an indirect but intended result of the player club or second chance game interactions with the player.

In one embodiment, the player may be incentivized to visit a specific location or establishment, such as a retailer, gambling establishment, non-gambling establishment, event or other location. This location may be an integral part of the gambling establishment, such as a casino property or a lottery ticket point of sale (POS) retailer or location, or it may be an unrelated location, such as a non-POS, non-gambling establishment or a special event.

For example, in order to gain access to second chance games, a gambling establishment such as a lottery may require a second chance indicator from a scratch ticket or lottery drawing ticket. This would give the player an incentive to visit a lottery POS location. This incentive could be made even more specific, by requiring the player to obtain a code or identifier from a particular location or set of locations, such as a specific retailer or retail chain, a specific restaurant or restaurant chain, or some other establishment or location. It can be appreciated that this establishment or location need not be a POS or a gambling establishment and that the required second chance indicator may not be from a gambling effort. The establishment may be any type of establishment and the second chance indicator may take many forms. For example, the establishment may be a supermarket chain and the second indicator may be a code found on a supermarket receipt.

In another example, a gambling establishment may incentivize a player to attend a specific event—for example a minor league baseball game—by making a certain second chance game, a certain sweepstakes, or some other customized or special experience or benefit available only to attendees of that event. This could be accomplished by restricting access to this special experience to players who have a second indicator that can be found only on the tickets of the minor league baseball game.

In a similar embodiment, the player may be incentivized to visit multiple locations or establishments, such as retailers, gambling establishments, non-gambling establishments, events or other locations. This could be accomplished by requiring players to enter a second chance indicator that is the combination of 2 or more codes or identifiers obtained from different establishments, events or other locations. Players may need two or more such codes or identifiers to gain access to customized second chance experience or some other benefit. For example, in order to play a special high stakes version of the second chance Texas Hold'em Poker game, a player may need a code or identifier from both a lottery scratch ticket purchased at a POS retailer and a Keno ticket purchased at a specific casino property. Or, access may be available to players with the code or identifier from the receipt of a purchase from a particular retail chain and a receipt from a specific restaurant chain. As in previous embodiments and examples, the establishments, events or locations may or may not be part of the gambling establishment and may or may not themselves be gambling establishments.

In another embodiment, the player may be incentivized to visit a specific website or take a specific action on a website. Such a website may belong to the gambling establishment or it may belong to an affiliated or non-affiliated third-party or other entity. For example, a casino may have a marketing agreement with a car dealer, and the casino may incentivize players to visit the website of the car dealer and fill out a contact form. In another example, an online poker establishment may wish incentivize players to follow Internet links to websites that advertise on the poker establishment website.

In another embodiment, the incentive or the desired player action may be more intangible. For example, the desired player action may be to spend more time playing specific game on the player club website. The incentive may be the player's desire to earn enough extra sweepstakes entries for a certain sweepstakes prize for which the player has an affinity. Or, the incentive may be the player's desire to earn enough points to be at the top of the leader board for that game.

Another embodiment uses an incentive that increases the value or perceived value of the prize, award or other benefit. For example, the award may be 10 entries into a sweepstakes. But if a player enters a second chance indicator, the award may be multiplied 2× or 10× times, etc. To further incentivize the player, the value increase may be variable; it could be randomly multiplied 2×, 3×, . . . 10×, N×, allowing for a possibly very significant increase in the value. For example, the 10 sweepstakes entries could be increase 50× and become 500 sweepstakes entries.

It can be appreciated that in similar fashion the player can be incentivized to take a variety of actions or a combination of actions. For example, the player may be required to fill out a survey before they can enable sweepstakes entries that were earned in a second chance game. Or the player may be required to visit a specific third-party website to obtain a code that is required to play a specific second chance game. A lottery player wishing to play second chance games may be required to collect a series of second chance indicators from lottery scratch tickets until the player has collected a predetermined set of indicators and must use them as a "super indicator" to qualify for second chance play. There are many embodiments of actions for which the player can be incentivized.

One skilled in the art can further appreciate that the player action desired to be taken may not necessarily be an action desired directly by the gambling establishment but may actually be an action desired by an affiliated or non-affiliated third party or other entity. In this case, the gambling establishment may be incentivizing action on behalf of another entity because the gambling establishment has partnered with another entity or the gambling establishment may be providing a service to another entity. The player action may be desired by both the gambling establishment and one or more other entities.

While many of the previous embodiments and examples show the player incentivized to take specific actions and obtain the required second chance indicator s prior to second chance play, it can be appreciate that the incentive to take action could also happen after the second chance play has been completed. This may be an even greater incentive, because the player has already revealed the outcome of the second chance game, but further action is required to enjoy the outcome. For example, a player may win, earn, or be awarded some incentive or prize via the outcome of a second chance game, such as 40 potential entries into a sweepstakes. But the player may be required to take some specific action in order to redeem, enable, or otherwise make practical use of the second chance game outcome, such as print a coupon and bring to a POS to be scanned and thereby enable the sweepstakes entries.

In another aspect of the invention, the incentives provided to incentivize the player to take a specific action may be determined in part or entirely based on the self-reported, observed or predicted affinities, preferences or predispositions of the player. This would serve both to help the gambling establishment determine which incentives are appropriate or worthwhile for the player and would serve to maximizing the likelihood that the player will be incentivized. For example, if the player has an affinity for travel to tropical destinations, the player's incentive might be sweepstakes entries for chance to win a Caribbean cruise.

In one embodiment of this aspect, the predicted or calculated worth of the player may be used by the gambling establishment to decide the value of the incentives it wishes to provide to the player. For example, a player's profile in a lottery player club may have estimated a proxy of worth indicating the player spends $800 per year on the lottery. The lottery may decide that it wishes to reinvest 25% of the players spend back in to the player, and consequently the player my receive $200 worth of incentives.

Simplifying Collection of Entries

It can be appreciated that players may have multiple gambling efforts or other interactions that qualify them for second chance play. For example, a casino player may have purchased multiple Keno tickets or a lottery player may have purchased multiple scratch and weekly drawing tickets. One aspect of the invention provides a convenient method for the player to group these entries so that they can be entered into the player club and second chance system as a group, rather than individually.

In one embodiment, multiple entries are tied together at the point of sale, time of award or purchase, or other point of time when the qualifying events or actions occur. When the player interacts with the system to use any one of the entries, all the entries in the group can automatically be applied at the same time, without the player needing to apply each entry individually.

For example, a clerk selling lottery tickets may scan the bar code on each ticket, indicating to the system via the POS terminal that these tickets are part of the same group. When the player later enters the second chance indicator from one ticket from the group into the player club system to use as a second chance entry, the system can automatically add all the tickets in this group and apply all the second chance entries, thereby saving the player the time and effort required to enter each ticket individually. In another example, multiple entries purchased or awarded at a casino or other gambling establishment could similarly be grouped together at the time of purchase or award, again saving the player time and effort when he or she uses the entries in the player club system.

In another embodiment, one or more entries are tied to a specific player account in the player club system. When the player accesses their account, these entries are automatically available in the system, saving the player the time and effort required to apply the entry or entries individually.

For example, a player purchasing lottery tickets could present the clerk at a POS retailer a player card with the player's account number or other unique identifier, a driver's license, or some other unique identifier that is or can be tied to the player's player club account. The clerk would then scan via the POS or otherwise indicate to the system that the lottery ticket or tickets being purchased are tied to the player club account of this specific player. The player would then be able to use these lottery tickets in second chance or other games by simply accessing the player club, without needing to key in any entries at all, because the system would already know that these entries belong to this player. In another example, entries earned or awarded at a casino or other gambling establishment could be could similarly be tied to the player's account within the system, and the player could play the entries without needing to key in any entries. For example, system 200 shown in FIG. 2 can be configured to perform these operations. In one example, lottery tickets purchase at a point of sale location can be tied to a specific player identifier. In some settings, the player can be issued a unique but anonymous player identifier. Anonymous identifiers can be employed in settings where having too much information on a particular player can be viewed as disadvantageous as discussed above. In one alternatively, a player can be permitted to select anonymity when setting up their own player account.

Player Club Card

In another aspect of the invention, the player is provided with a player club card that identifies the player's player club account and/or other player information. This card may contain additional player information directly, or it may allow the POS or other system to access additional player information. This account information can be used to tie the player's second chance entries directly to the player's player club account, in a fashion similar to the previously described embodiments related to simplifying collection of entries.

Furthermore, the additional information provided directly or indirectly by the player club card can be used to further simplify or otherwise improve the player's gaming transaction. For example, in the case of a lottery, the additional account information available via the player club card may include the player's favorite lottery numbers. By providing the player club card at the POS, the player may be able to purchase a lottery ticket using their favorite lottery numbers, without the inconvenience of having to fill out a lottery number-selection entry form. In another example, the information could contain information about the player's subscribed lottery games, and the POS system could automatically complete a purchase for the player, creating one or more lottery entries in the player's subscribed game or games, possibly using the player's favorite or pre-selected lottery numbers.

Since the player card is linked to the player's player club account, information from the player's profile can be used to customize or otherwise improve the player's experience at the POS based on the self-reported, observed, or predicted preferences, affinities, or predispositions from the player's profile. For example, if the player had a reported or predicted affinity for the local baseball team, a lottery ticket purchased by the player and printed on demand at the POS may include information about the time and place of the next baseball game. In another example, a casino player with an affinity for baseball who was playing a video poker game may see the game customized to include a baseball theme or to use a color scheme of the local baseball team.

Similarly, the information from the player's profile could be used to sell, cross sell, up sell, or market to the player or to advance some other goal of the gambling establishment or an affiliated or non-affiliated third party or entity. For example, a lottery player with a reported or predicted affinity for baseball who was buying lottery tickets using their player card may be may prompted to purchase tickets to the next local baseball game or to purchase a themed souvenir baseball.

It can be appreciate that this player card may take many forms. For example, it may be a physical card, ornament, key chain, phone, PDA, or other conveniently carried device with a bar code, magnetic stripe, RFID, infrared transmitter, or other mechanism that can communicate the player's information to a POS or other system. This card may also be virtual, and may be transmitted via a cellular telephone, Wi-Fi, Bluetooth or other transmitter. The virtual card may be embodied and transmitted in an SMS, Twitter, email, or other electronic message or form. The card can exist both virtually and physically.

Various embodiments according to the present invention may be implemented on one or more computer systems. These computer systems may be, for example, general-purpose computers such as those based on Intel Atom, Core, or PENTIUM-type processor, IBM PowerPC, AMD Athlon or Opteron, Sun UltraSPARC, or any other type of processor. It should be appreciated that one or more of any type computer system can be used to provide access to second chance games, deliver second chance identifiers, provide for redemption control of second chance benefits, determine outcomes, build player profiles, tailor primary and/or secondary games to player preferences, incent player behavior, facilitate registration for membership, facilitate redemption of second chance benefits, and providing for anonymous and aggregate tracking of player behavior according to various embodiments of the invention. Further, the system may be located on a single computer or may be distributed among a plurality of computers attached by a communications network.

A general-purpose computer system according to one embodiment of the invention is configured to perform any of the described operations and/or algorithms, including but not limited to providing for management of content, management of second chance games, display of a user interface to enter second chance games, display of a user interface to external second chance identifiers and/or identifying information, register for player club memberships, track and analyze player activity, build player profiles, infer affinities from activity, gate access to second chance games and/or second chance redemption, among other options. It should be appreciated, however, that the system may perform other operations and/or algorithms, including operations for periodically awarding second chance credits, providing teaser awards, accepting user entered player information, displaying questionnaires, tracking gaming and/or non-gaming activity, accessing predetermined outcomes, generating randomly determined outcomes, engaging players based on profile, generating anonymous player profiles, integrating player information from third parties, generating a value estimate for a player, generating predictions of player value, generating aggregate player profile information, providing for thematic extension of primary game play as part of a second chance game, permitting second chance game themes to be continued in play of a primary game, aggregating second chance entries for facilitated registration and/or redemption, etc. The operations and/or algorithms described herein can also be encoded as software executing on hardware that define a processing component, that can further define portions of a specially configured general purpose computer, reside on an individual specially configured general purpose computer, and/or reside on multiple specially configured general purpose computers.

Figure 6:
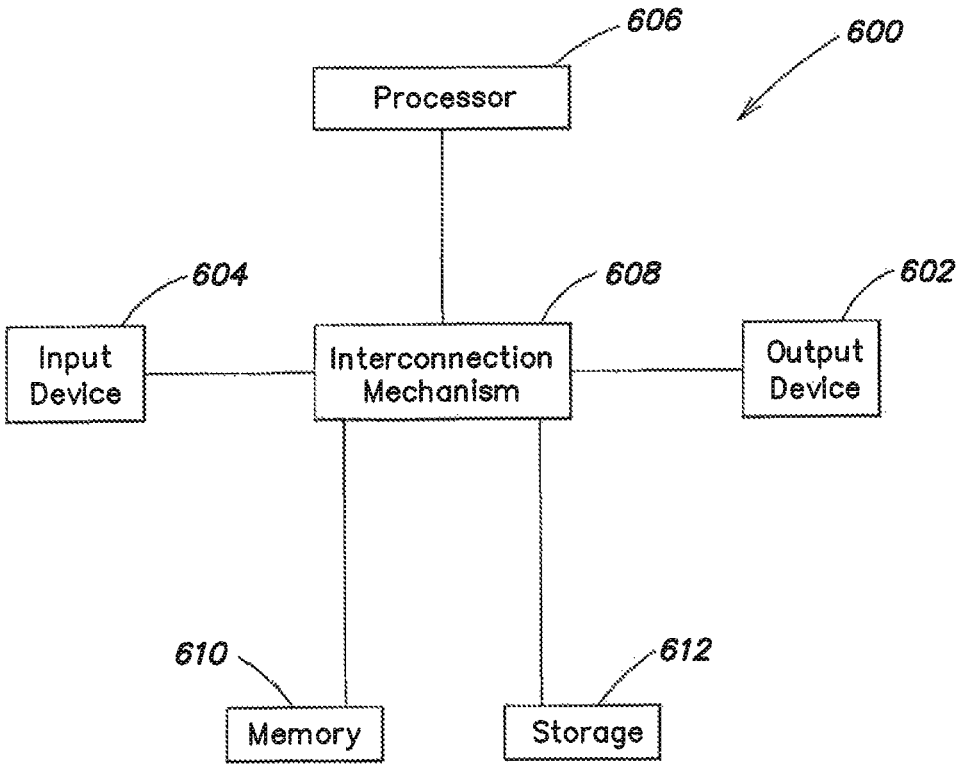
FIG. 6 is a block diagram of an example system for providing a second chance game, according to aspects of the invention.

FIG. 6 shows a block diagram of a specially configured general-purpose computer system 600 in which various aspects of the present invention can be practiced. For example, various aspects of the invention can be implemented as specialized software executing in one or more computer systems including general-purpose computer systems 904, 906, and 908 communicating over network 902 shown in FIG. 9. Computer system 600 may include a processor 606 connected to one or more memory devices 610, such as a disk drive, memory, or other device for storing data. Memory 610 is typically used for storing programs and data during operation of the computer system 600. Components of computer system 600 can be coupled by an interconnection mechanism 608, which may include one or more busses (e.g., between components that are integrated within a same machine) and/or a network (e.g., between components that reside on separate discrete machines). The interconnection mechanism enables communications (e.g., data, instructions) to be exchanged between system components of system 600.

Computer system 600 may also include one or more input/output (I/O) devices 604, for example, a keyboard, mouse, trackball, microphone, touch screen, a printing device, display screen, speaker, etc. Storage 612, typically includes a computer readable and writeable nonvolatile recording medium in which instructions are stored that define a program to be executed by the processor or information stored on or in the medium to be processed by the program.

Figure 7:
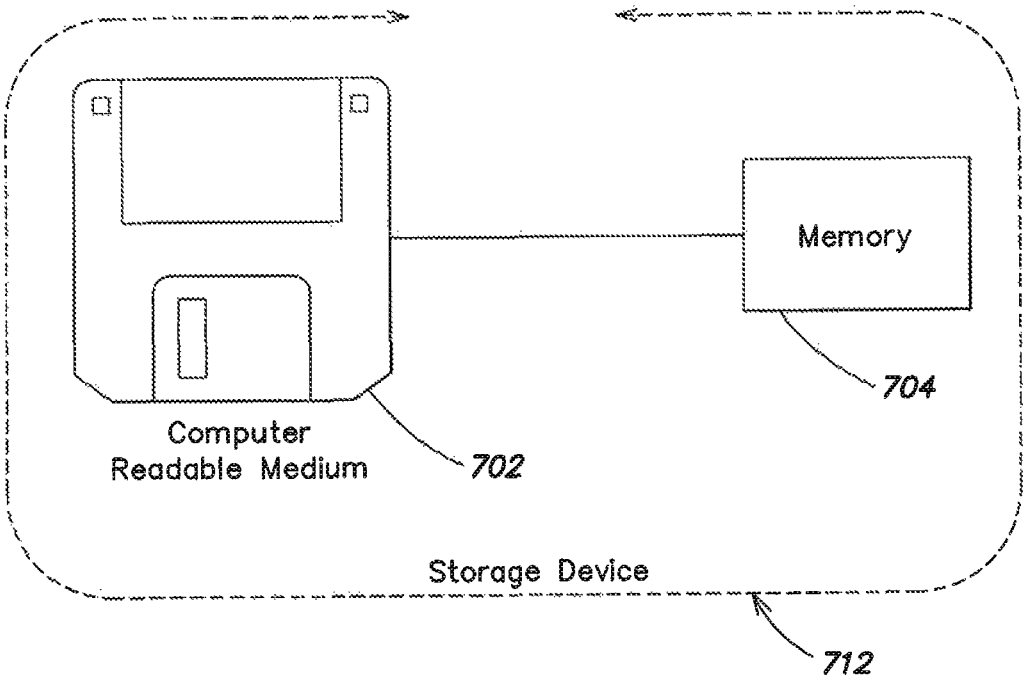
FIG. 7 is a block diagram of an example system for providing a second chance game, according to aspects of the invention.
Figure 8:
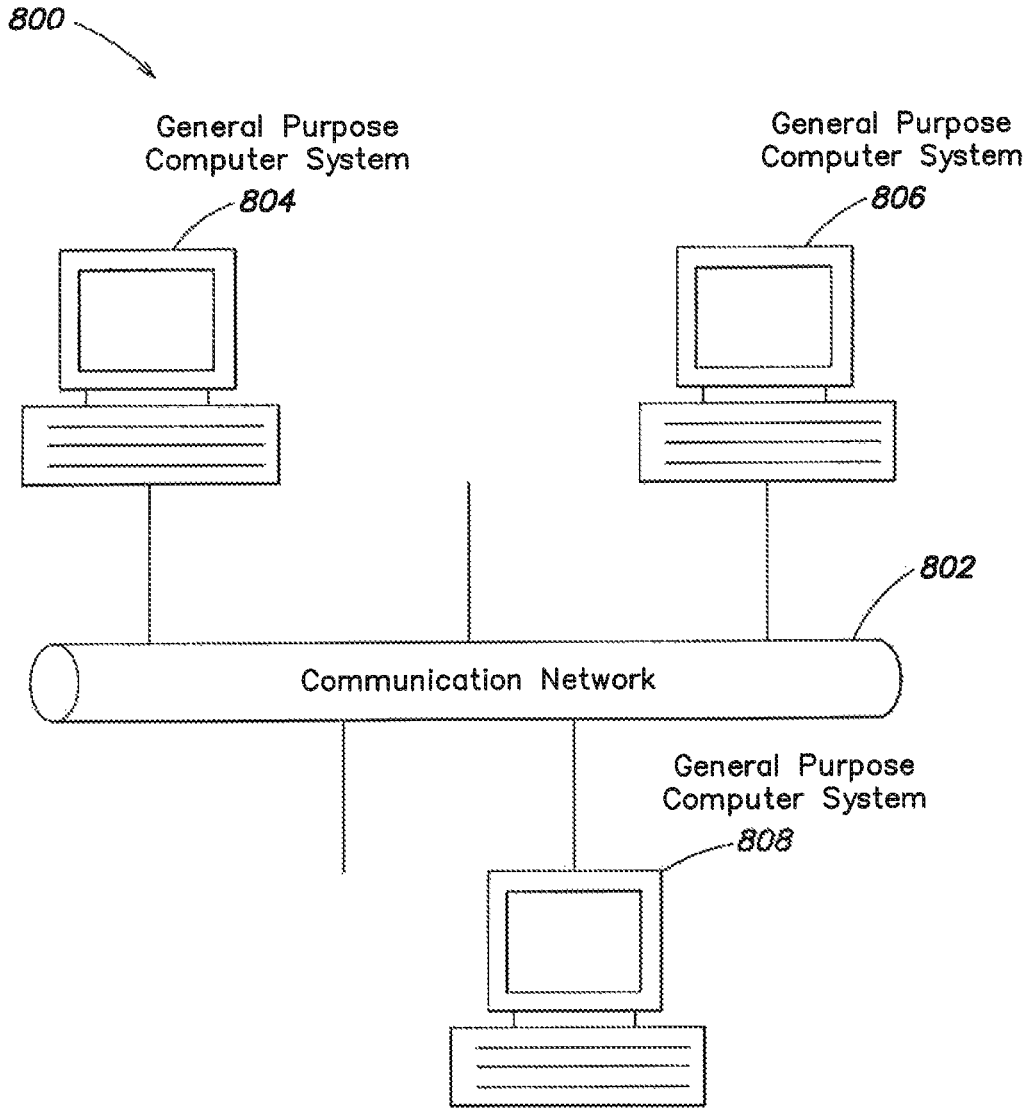
FIG. 8 is a block diagram of an example system for providing a second chance game, according to aspects of the invention.

The medium may, for example, be a disk 702 or flash memory as shown in FIG. 7. Typically, in operation, the processor causes data to be read from the nonvolatile recording medium into another memory 704 that allows for faster access to the information by the processor than does the medium. This memory is typically a volatile, random access memory such as a dynamic random access memory (DRAM) or static memory (SRAM).

Referring again to FIG. 6, the memory can be located in storage 612 as shown, or in memory system 610. The processor 606 generally manipulates the data within the memory 610, and then copies the data to the medium associated with storage 612 after processing is completed. A variety of mechanisms are known for managing data movement between the medium and integrated circuit memory element and the invention is not limited thereto. The invention is not limited to a particular memory system or storage system.

The computer system may include specially-programmed, special-purpose hardware, for example, an application-specific integrated circuit (ASIC). Aspects of the invention can be implemented in software, hardware or firmware, or any combination thereof. Although computer system 600 is shown by way of example as one type of computer system upon which various aspects of the invention can be practiced, it should be appreciated that aspects of the invention are not limited to being implemented on the computer system as shown in FIG. 6. Various aspects of the invention can be practiced on one or more computers having a different architectures or components than that shown in FIG. 6.

It should be appreciated that the invention is not limited to executing on any particular system or group of systems. Also, it should be appreciated that the invention is not limited to any particular distributed architecture, network, or communication protocol.

Various embodiments of the invention can be programmed using an object-oriented programming language, such as Java, C++, Ada, or C# (C-Sharp). Other object-oriented programming languages may also be used. Alternatively, functional, scripting, and/or logical programming languages can be used. Various aspects of the invention can be implemented in a non-programmed environment (e.g., documents created in HTML, XML or other format that, when viewed in a window of a browser program, render aspects of a graphical-user interface (GUI) or perform other functions). The system libraries of the programming languages are incorporated herein by reference. Various aspects of the invention can be implemented as programmed or non-programmed elements, or any combination thereof.

Various aspects of this invention can be implemented by one or more systems similar to system 600. For instance, the system can be a distributed system (e.g., client server, multi-tier system) comprising multiple general-purpose computer systems. In one example, the system includes software processes executing on a system associated with conducting second chance games, which can include operations such as associating a second chance game with a primary game, requiring registration and/or unique identification of participating players, building player profiles based on gaming and/or non-gaming activity, providing player club systems for gaming activity including lottery play, providing club systems for non-gaming activity, generating player affinities directly and/or indirectly, conducting and/or managing sweepstakes, and developing aggregate player profiles. These systems may permit the end users to access game information, account information, and/or qualification requirements in data locally or may permit remote access to such content, the end users, for example, can employ a web browser to access game content and associated information, access a web page to participate in for example second chance games, and/or redeem second chance benefits, among other operations.

There can be other computer systems that perform functions such as receiving and associating user account information with player club accounts, managing second chance games, managing game content, managing outcome generation and/or retrieval, among other functions. These systems can be distributed among a communication system such as the Internet. One such distributed network, as discussed below with respect to FIG. 9, can be used to implement various aspects of the invention.

FIG. 9 shows an architecture diagram of an example distributed system 900 suitable for implementing various aspects of the invention. It should be appreciated that FIG. 9 is used for illustration purposes only, and that other architectures can be used to facilitate one or more aspects of the invention. System 900 may include one or more general-purpose computer systems distributed among a network 902 such as, for example, the Internet. Such systems may cooperate to perform functions related to conducting second chance games. In an example of one such system, one or more users operate one or more client computer systems 904, 906, and 908 through which the user/player can access a second chance game interface, access game content, register for membership accounts, enter indentifying information, enter second chance identifiers, and potentially redeem second chance benefits. It should be understood that the one or more client computer systems 904, 906, and 908 may also be used to access, for example, account registration systems, second chance game content, user profile management, second chance administration, etc. In one example, users interface with the system via an Internet-based interface.

In another example, a system 904 includes a browser program such as the Microsoft Internet Explorer application program, Mozilla's FireFox, or Google's Chrome browser through which one or more websites can be accessed. Further, there can be one or more application programs that are executed on system 904 that perform functions associated with conducting second chance games. For example, system 904 may include one or more local databases for storing, caching and/or retrieving player information, player profiles, player activity, second chance credit balance, etc.

Network 902 may also include, as part of the system for conducting second chance games, one or more server systems, which can be implemented on general-purpose computers that cooperate to perform various functions including accessing a second chance interface, entering indentifying information, retrieving database information on a player, player profile and/or player accounts, executing interface processes between point of sale locations and a second chance game system among other functions. System 900 may execute any number of software programs or processes and the invention is not limited to any particular type or number of processes. Such processes can perform the various workflows associated with a system for conducting second chance games and any associated methods.

Having thus described several aspects and embodiments of this invention, it is to be appreciated that various alterations, modifications and improvements will readily occur to those skilled in the art. Such alterations, modifications, and improvements are intended to be part of this disclosure, and are intended to be within the spirit and scope of the invention. Accordingly, the foregoing description is by way of example only.

It should be appreciated that use of the term "gambling establishment" refers to any lawful gambling establishment, either physical or online or both. Physical casinos, Internet casinos, lotteries, racetracks, betting shops and Internet gaming establishments are common examples of such gambling establishments that are lawful in certain jurisdictions. It can also be appreciated that some gambling establishments may provide gaming as a subset of other offerings or services. For example, a bar or restaurant whose primary business is selling food and drinks may also provide Keno gaming. Similarly, a convenience store whose primary business is selling retail items may also sell lottery tickets. It can further be appreciated that all aspects of this invention may be applied to any other entities that represent a lawful gambling establishment. These gambling establishments may be accessed at physical locations or online or both.

The term online refers to access of one or more of the invention's components via a computer, phone, handheld device, or similar device. Such online access typically occurs through the Internet, a private or public computer network, or a similar network.

The term "player club" refers to any grouping of an establishment's patrons that confers some tangible or perceived benefit to the members of the group. For example, such a Players Club may take the form or a mailing list (USPS, email, or other), a loyalty program, an online members-only area, or some other grouping of patrons.

Use of ordinal terms such as "first", "second", " third", "a", "b" "c" etc., in the claims to modify or otherwise identify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A computer-implemented method for conducting a game of chance, the method comprising acts of:

providing, by a computer system, a second chance identifier to a player from play of a primary game, wherein the second chance identifier corresponds to additional play opportunities for the player;

requiring receipt, by a game interface, of the second chance identifier from the player in order to play the additional play opportunities;

permitting, by the computer system, the player to play one or more of the additional play opportunities in response to receiving the second chance identifier;

tracking, by the computer system, player activity with respect to play of the additional play opportunities;

generating, by the computer system, a model of the player based at least partially on the tracked information;

using the model to determine a player affinity and to predict a player reaction to an incentive;

customizing, by the computer system, the additional play opportunities based on at least one of the player affinity or the player reaction;

and revealing, via the game interface, an outcome of the game of chance to the player during play of the additional play opportunities based on the model.

2. The method according to claim 1, further comprising providing, by the computer system, an opportunity for the player to enter into a membership club in order to participate in the additional play opportunities.

3. The method according to claim 1, further comprising permitting the player to select one of the additional play opportunities to play.

4. The method according to claim 1, further comprising associating the second chance identifier with one or more predetermined benefits, wherein the one or more predetermined benefits are provided to the player during play of the additional play opportunities.

5. The method according to claim 1, wherein the act of tracking player activity with respect to the additional play opportunities includes an act of storing player activity information in a database.

6. The method according to claim 1, further comprising providing the second chance identifier to the player regardless of whether the player wins or loses the primary game.

7. The method according to claim 1, further comprising an act of permitting the player to redeem the outcome of the game of chance.

8. The method according to claim 1, wherein the act of permitting the player to play the additional play opportunities occurs in response to an activity performed by the player.

9. The method according to claim 8, wherein the activity performed by the player includes visiting at least one of gambling activity, activity in a gaming establishment, activity in a redemption location, activity in an affiliated location, activity in a partner location, or activity in a predetermined online or physical location.

10. The method according to claim 1, further comprising an act of associating game detail of the primary game with the additional play opportunities.

11. The method according to claim 10, wherein the game detail includes at least one of nature of game, type of game, value of game, time play, location of play, place of purchase, theme of game, storyline of game, point in time of storyline of game, or other details associated with the primary game.

12. The method according to claim 1, further comprising an act of awarding game credits during the primary game, wherein the game credits are required to play the additional play opportunities.

13. The method according to claim 12, wherein the act of awarding game credits occurs in response to at least one of receiving the second chance identifier, reaching a scheduled distribution period, reaching a predefined event associated with a gaming establishment, or reaching a predefined event associated with the player's information.

14. The method according to claim 1, further comprising an act of printing the second chance identifier on at least one of an issued ticket, a receipt, a scratch ticket, a lottery ticket, a receipt for purchase, a receipt for an award, a ticket to an event, another receipt, a direct market mailing, an electronic communication, a cellular network communication, a wireless device communication, or a newspaper advertisement, and/or conveying a second chance identifier verbally via at least one of a telephone network, an advertisement, or a public address system.

15. The method according to claim 1, further comprising an act of collecting player information during play of the additional play opportunities.

16. The method according to claim 15, wherein the player information includes at least one of information associated with play of the primary game, play of the second chance game, activities performed by the player associated with the second chance game, player preferences, player affinities, demographic information, or personal information.

17. The method according to claim 15, further comprising an act of generating a player profile from collected player information.

18. The method according to claim 15, wherein the act of collecting player information includes acts of:

associating information on the primary game with the second chance identifier; and storing information on the primary game in response to access of the additional play opportunities.

19. The method according to claim 15, wherein the act of collecting player information includes acts of:

associating non-gaming activity with the second chance identifier; and storing information on the non-gaming activity in response to access of the additional play opportunities.

20. The method according to claim 1, further comprising an act of establishing the outcome of the game of chance to conform to the player affinity.

* * * * *